US005570546A

United States Patent [19]

Butterworth et al.

[11] Patent Number: 5,570,546

[45] Date of Patent: Nov. 5, 1996

[54] SYSTEM FOR RAISING AND LOWERING COMMUNICATIONS EQUIPMENT

[75] Inventors: Robert S. Butterworth, Glenmoore; David O'Brien, Downingtown, both of Pa.

[73] Assignee: American High Mast Systems, Inc., Downingtown, Pa.

[21] Appl. No.: 509,311

[22] Filed: Jul. 31, 1995

[51] Int. Cl.[6] ..... E04H 12/34

[52] U.S. Cl. ..... 52/111; 52/119; 52/121; 52/120; 343/890

[58] Field of Search ..... 52/111, 113, 119, 52/120, 121; 343/890, 883, 874; 472/2, 3, 39

[56] References Cited

U.S. PATENT DOCUMENTS

| | | | |
|---|---|---|---|
| 525,031 | 8/1894 | Smith | 472/2 |
| 750,140 | 1/1904 | Welsh | 472/2 |
| 1,712,340 | 5/1929 | Fankhauser et al. | 472/2 |
| 2,470,998 | 5/1949 | McPherson | 52/120 X |
| 2,639,381 | 5/1953 | Thompson et al. | 343/890 X |
| 2,698,873 | 1/1955 | Allsworth et al. | 52/121 X |
| 3,101,134 | 8/1963 | Winkelmann, Sr. | 52/111 |
| 4,209,789 | 6/1980 | Snedkerud | 343/890 X |
| 4,356,498 | 10/1982 | Pollard | 343/890 |
| 4,468,671 | 8/1984 | Ellingson et al. | 343/890 X |
| 4,785,309 | 11/1988 | Gremillion | 343/883 |
| 5,200,759 | 4/1993 | McGinnis | 343/890 |
| 5,233,362 | 8/1993 | Villaseca et al. | 343/847 X |
| 5,291,211 | 3/1994 | Tropper | 343/890 |

OTHER PUBLICATIONS

Summit Manufacturing Inc. Catalogue entitled "Utility Lighting Transportation Communication", Cover Sheet and p. 6.

*Primary Examiner*—Wynn E. Wood
*Assistant Examiner*—Aimee E. McTigue
*Attorney, Agent, or Firm*—Caesar, Rivise, Bernstein, Cohen & Pokotilow, Ltd.

[57] ABSTRACT

A system for lowering and raising telecommunications equipment along a mast pole. The system comprises a mast pole, a platform means, a frame means, a plurality of lift cables, a hoisting means and a transition means. The platform means surrounds the external surface of the mast pole and is moveable along the length thereof. The platform means is arranged for mounting of telecommunications equipment thereon. The frame means is attached at the open upper end of the mast pole shaft and comprises pulley means, means for guiding at least one lift cable and means for guiding at least one telecommunications cable, i.e., signal cable or power cable. Each lift cable has a first end connected to the platform means and extends through the guiding means and through the passageway of the mast pole. The hoisting means is secured to the lower end of the mast pole and is provided for selectively raising and lowering the platform means. The pulley means includes a winch cable having a free end. The transition means is located within the passageway of the mast pole and is provided to couple the second end of the lift cables to the free end of the winch cable. The transition means also provides a means for retaining at least one telecommunications cable therein.

52 Claims, 16 Drawing Sheets

236
200
36
240
244
236a
188
36
240
244
24
100
292
242
284
76
246
260
10
10
9
9
36
296
243a

SYSTEM FOR RAISING AND LOWERING COMMUNICATIONS EQUIPMENT

BACKGROUND OF THE INVENTION

This invention relates generally to a system for raising and lowering antennae and related equipment used in cellular telecommunications systems and in PCS (personal communications systems). In particular, the invention relates to a mast pole shaft which is provided with a ring or platform assembly that is raised and lowered by use of lift cables that are operatively connected to a hoisting means located in the lower portion of the mast pole shaft through a transition assembly provided in association therewith. The system of the present invention provides means for guiding lift cables and telecommunications cables, e.g., coaxial signal cables and power cables, during raising and lowering of the antennae and related equipment.

Prior art mast pole systems used in connection with the operation of wireless cellular telecommunications systems require that antennae used as part of such telecommunications equipment be permanently affixed at an elevated position near the top of a mast tower, tubular pole or similar lattice structure. Typically, multiple antennae are affixed near the top of the mast tower, each antenna having an associated coaxial signal cable connecting it with ground-positioned ancillary equipment. In order to enable service personnel to provide maintenance to these pole mounted antennae, steps, ladders or other climb facilitating means are commonly permanently attached to the pole provided so that they extend from near ground level to the elevated position where the antennae are located. Additionally, safety regulations require that current technology mast poles be provided with safety climbing equipment and a service platform mounted at the elevated position where antennae and other related telecommunications equipment are located to enable safe performance of service work by service personnel.

Many in industry and public have considered the presence of such permanently mounted climb facilitating means and safety platforms on a communications pole to detract from the aesthetic appearance of the site on which the communications pole is located. In fact, the presence of such on a communications pole has been reason enough for rejection of a proposal during a zoning review. Additionally, the installation of steps, safety climbing equipment and safety platforms increases cost of manufacture. Therefore, there has been a long-felt need by the public and those in industry for a communications pole that eliminates the need for steps, safety platforms and safety climbing devices and provides a more streamlined and visually appealing appearance that would be more acceptable to the public and zoning review boards. Additionally, the presence of permanently mounted climb facilitating means presents a potentially serious liability problem in the event a trespasser should suffer an accident as the result of climbing such equipment and falling therefrom.

Since under prior art systems, service can only be performed at the elevated position where the antenna are permanently affixed, safety is a matter of great importance. Only service personnel having specialized training as steeplejacks may be utilized for providing service to pole mounted equipment. Since relatively few service people possess the skills of a steeplejack, such individuals are able to command a higher fee for their services and are usually in great demand and are often not available. Further, while a steeplejack repairman is performing service at an elevated position, under safety requirements, a second service person must be stationed at the base of the pole while the steeplejack is working at an elevated position to provide assistance in the event of an emergency. Therefore, from both a cost and safety standpoint, there has been a long-felt need in the industry for a system that enables service personnel not having the steeplejack skills to perform service work safely.

Additionally, under prior art systems, antennae are customarily mounted at an elevated position on the mast pole while all other related telecommunications equipment, e.g., radio frequency equipment, power supplies, batteries, rectifiers, are positioned at ground level and situated around the base of the pole. By positioning all telecommunications equipment other than antennae at ground level rather than on the mast pole, service may be provided to this equipment without requiring service personnel to climb up the mast pole.

However, positioning such equipment at ground level has several drawbacks. For example, a considerably larger sized lot is required to accommodate this equipment. Further, in order to protect against vandalism and weather, it is not uncommon for the ground stationed equipment to be housed within a trailer or similar sheltering structure which further increases the required lot size and cost. Additionally, it is not uncommon for fencing to be erected around ground stationed equipment to deter vandalism thus further increasing the required lot size and cost. Accordingly, in order to position telecommunications equipment at ground level, a relatively large tract of land must be provided on which a shelter can be located and fencing can be erected in order to house and protect such equipment. Therefore, there is a long-felt need for a system that can be implemented on a smaller tract of land and that can be implemented without the necessity of utilizing the costly protective measures mentioned above.

There are raise/lowering devices in the prior art that are dedicated to the purpose of raising and lowering lighting systems. These lighting systems also known as luminaires. Such raise/lowering devices are manufactured by several different companies including American High Mast, Inc., the assignee of the present invention and application. Such systems have been in existence and commercially available for some time and routinely appear in parking lots, shopping centers, highways, toll plazas, airports and other locations where outdoor illumination is required. Under these prior art lighting raise/lowering devices for lights, a plurality of luminaires are attached to a platform assembly that surrounds the outside of the mast pole. The platform assembly is typically suspended by three lift cables that connect thereto and extend through the interior of the mast pole and connect to a hoisting means, e.g., an internal motor. Additionally, one or at most two power cables connected to the luminaires extend through the mast pole and connect at their second end to power supplies positioned at ground level. However, under these prior art systems, since only three lift cables and one or two power cables actually extended through the interior of the mast pole shaft there was no reason to provide a means for routing these cables or for assuring their proper orientation as they feed out of the mast pole and connect to the luminaires and other related equipment mounted on the platform assembly.

While the prior art raise/lowering devices are adequate for their intended purpose, i.e., raising and lowering luminaires, they are inadequate for raising and lowering antennae and other related telecommunications equipment because these devices provide no means for routing the additional telecommunications cables, e.g., coaxial signal cables and power cables, and lift cables associated with such equipment. Under the prior art, a single large opening is provided at the top of the mast pole through which all cables are fed. This large opening is inadequate for routing and assuring proper orientation for a plurality of telecommunications cables, e.g., multiple coaxial signal cables, a plurality of power cables, in addition to at least six lift cables. Therefore there is a long-felt need for a system for routing a significant number of cables, e.g., telecommunications cables, lift cables.

Under the prior art luminaire raise/lowering devices where such a single large opening is utilized for routing cables, a special dome is typically provided over the large opening for the purpose of protecting against the entry of rain water, birds and bird droppings into the pole.

Further, under prior art raise/lowering systems for luminaires, a mechanical clutch is coupled to the electrical motor for the purpose of controlling the delivery of torque from the motor to the gears. Under these prior art systems, once a predetermined amount of torque is reached, such as when the platform assembly reaches the elevated position and abuts the headframe assembly, the mechanical clutch disengages the motor from the gears in order to discontinue the raising of the platform assembly. Unless a clutch is provided, the motor will continue to exert torque pulling on lift cables and platform assembly. Such torque may damage the motor and/or other system components and eventually result in one or several lift cables being broken away from the platform assembly they are supporting.

Because the clutch is a device that is mechanical in nature, it may fall out of calibration, which can result in damage to the system and the motor. When utilizing a raise/lowering device for raising and lowering expensive telecommunications equipment, there must be provided a more accurate and reliable means for disengaging the motor from the gears once the platform assembly reaches the elevated position and once the platform assembly reaches the lowered position for servicing. Further, there is a need for a means for slowing the ascent and descent of the platform assembly as it approaches the elevated and lowered positions.

OBJECTS OF THE INVENTION

It is a general object of this invention to provide a raising and lowering apparatus for communications equipment which overcomes the disadvantages of the prior art.

It is another object of this invention to provide a raising and lowering apparatus for communications equipment that enables the servicing of pole mounted equipment at ground level.

It is another object of this invention to provide a raising and lowering apparatus for communications equipment which eliminates the necessity of utilizing service personnel having steeplejack ability.

It is another object of this invention to provide a raising and lowering apparatus for communications equipment which provides an increased level of safety to service personnel.

It is another object of this invention to provide a raising and lowering apparatus for communications equipment which reduces insurance costs.

It is another object of this invention to provide a raising and lowering apparatus for communications equipment which reduces service manpower requirements.

It is another object of this invention to provide a raising and lowering apparatus for communications equipment which minimizes service costs.

It is another object of this invention to provide a raising and lowering apparatus for communications equipment which reduces repair time.

It is another object of this invention to provide a raising and lowering apparatus for communications equipment which provides increased security by reducing the potential for theft or vandalism.

It is another object of this invention to provide a raising and lowering apparatus for communications equipment which does not detract from the aesthetic appearance of the site on which it is located.

It is another object of this invention to provide a raising and lowering apparatus for communications equipment which can be implemented on a relatively smaller tract of land.

It is another object of this invention to provide a raising and lowering apparatus which allows for telecommunications equipment to be situated closer to antennae thus increasing the performance characteristics of said telecommunications equipment.

It is another object of this invention to provide a raising and lowering apparatus for communications equipment which is more acceptable to zoning review panels.

It is another object of this invention to provide a raising and lowering apparatus for communications equipment having aesthetically pleasing visual appearance.

It is another object of this invention to provide a raising and lowering apparatus for communications equipment that eliminates the need for steps, safety platforms or the use of safety climbing devices.

It is another object of this invention to provide a raising and lowering apparatus for communications equipment that includes a motor and provides a reliable and accurate means for disengaging the motor once the platform assembly has reached the elevated position.

It is another object of this invention to provide a raising and lowering apparatus for communications equipment that includes a motor and provides a means for accurately controlling the speed of the internal motor so as to control the speed of ascent and descent of the platform assembly as it approaches the elevated and the lowered positions, respectively.

It is another object of this invention to provide a raising and lowering apparatus for communications equipment that operates at multiple speeds.

It is another object of this invention to provide a raising and lowering apparatus for communications equipment that provides a means for guiding a plurality of lift cables and various telecommunications cables, e.g., signal cables and power cables.

It is another object of this invention to provide a raising and lowering apparatus for communications equipment that does not require the use of a dome or other sheltering device.

SUMMARY OF THE INVENTION

These and other objects of this invention are achieved by providing a system for lowering and raising telecommunications equipment along a mast pole. In accordance with one aspect of this invention, the telecommunications equipment raise/lowering system comprises a mast pole, a platform means, a frame means, a plurality of lift cables, a hoisting means and a transition means. The platform means surrounds the external surface of the mast pole and is moveable along the length thereof. The platform means is arranged for the mounting of telecommunications equipment thereon. In one embodiment the platform means comprises a circular ring surrounding the mast pole, the ring having a plurality of arms attached thereto and extending outwardly therefrom. The arms being arranged to support at least one antenna or at least one luminaire thereon. In another embodiment, the platform means comprises a multi-tiered triangle-shaped structure that is arranged to support antennae and additional pieces of telecommunications equipment.

The frame means is attached at the open upper end of the mast pole shaft and comprises pulley means, means for guiding at least one lift cable and means for guiding at least one telecommunications cable. The telecommunications cable being guided could be one or more signal cables, one or more power cables, or a combination of signal and power cables. Each lift cable has a first end connected to the platform means and extends through the guiding means and through the passageway of the mast pole. The hoisting means is secured to the lower end of the mast pole and is provided for selectively raising and lowering the platform means. The hoisting means could be an internal motor linked to a winch drum on which a winch cable is wound. Additionally, gears could be provided in combination with the motor to achieve a suitable rate of ascent and decent of the platform assembly. The transition means is located within the passageway of the mast pole and is provided to couple the second end of the lift cables to the free end of the winch cable. The transition means also provides a means for retaining at least one telecommunications cable therein. The telecommunications cable being retained therein could be one or more signal cables, e.g., coaxial cables, one or more power cables, or a combination of signal and power cables.

In accordance with another aspect of this invention, a base assembly is provided in combination with a raise/lowering system.

In accordance with another aspect of this invention, a programmable frequency inverter is provided in combination with a raise/lowering system that can detect the amount of current being drawn by the internal motor. As a safety device, the frequency inverter is arranged to shut down the motor when a predetermined level of current has been exceeded.

In accordance with another aspect of this invention, a means for controlling the speed of ascent and descent of the platform assembly is provided.

DETAILED DESCRIPTION OF THE PREFERRED EMBODIMENTS

Figure 1:
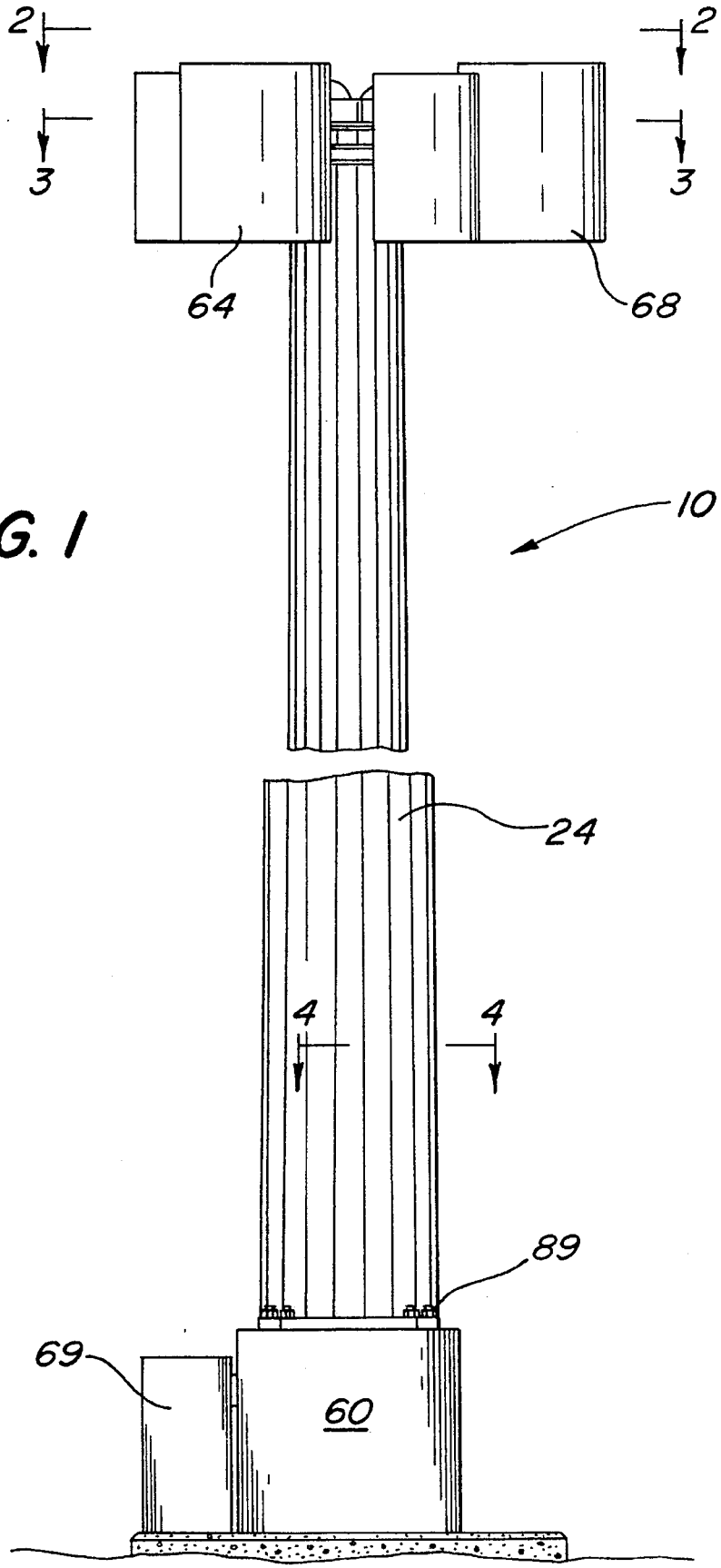
FIG. 1 is a side elevation view showing a preferred embodiment of the system of the present invention with the platform assembly in the raised position.

Referring now to various figures of the drawings where like reference numerals refer to like parts, there is shown at 10 in FIG. 1, the system for raising and lowering communications equipment constructed in accordance with this invention.

The details of the system 10 will be described later. FIG. 1 shows the preferred embodiment of the system 10 of the present invention which includes a platform assembly 32 (FIG. 2) arranged to support a plurality of antennae 12 (FIG. 2) within a plurality of antenna cylinders 64 at an elevated position on a conventional elongated hollow tapered mast pole 24 while various components of radio frequency equipment and power supplies (to be described later) are positioned at ground level housed within a cabinet 69 located adjacent the base of the pole.

In accordance with the present invention, the raise lowering system 10 is provided to enable servicing of the equipment mounted on the platform assembly by lowering that assembly to ground level, thus obviating the need for climbing up to the top of the pole to access the same. By providing a means for lowering the antennae 12 and other related equipment to ground level for servicing, the necessity of utilizing service personnel having steeplejack ability has been eliminated. Additionally, the necessity for providing steps, safety platforms and safety climbing devices on the communications pole has been eliminated. The system of the present invention provides an increased level of safety for service personnel, reduces service and insurance costs, reduces service manpower requirements and serves as a more acceptable and visually appealing alternative to zoning review panels.

Figure 1A:
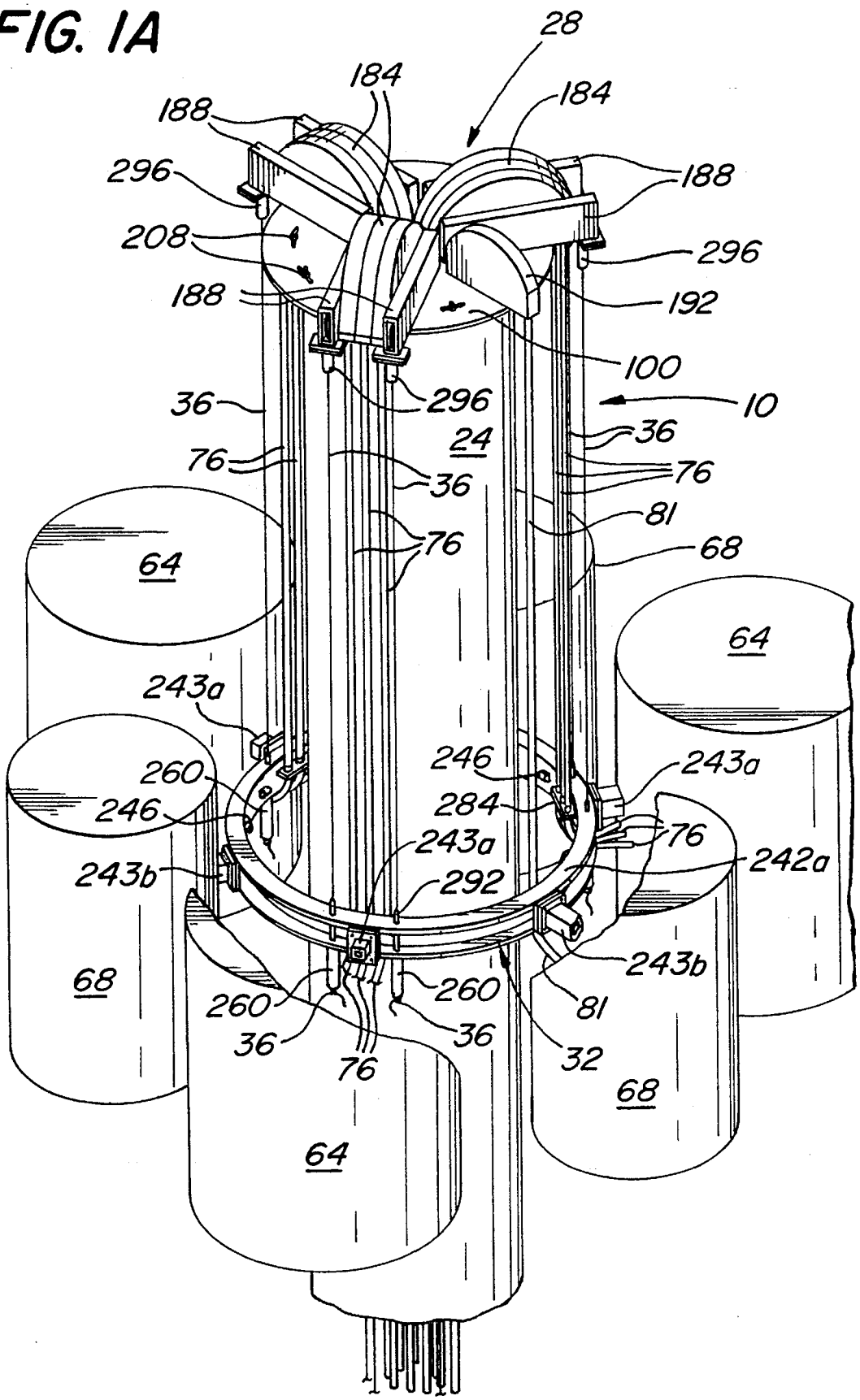
FIG. 1A is an isometric view of the upper portion of the preferred embodiment of the system shown in FIG. 1 with the platform assembly in a partially lowered position.
Figure 5:
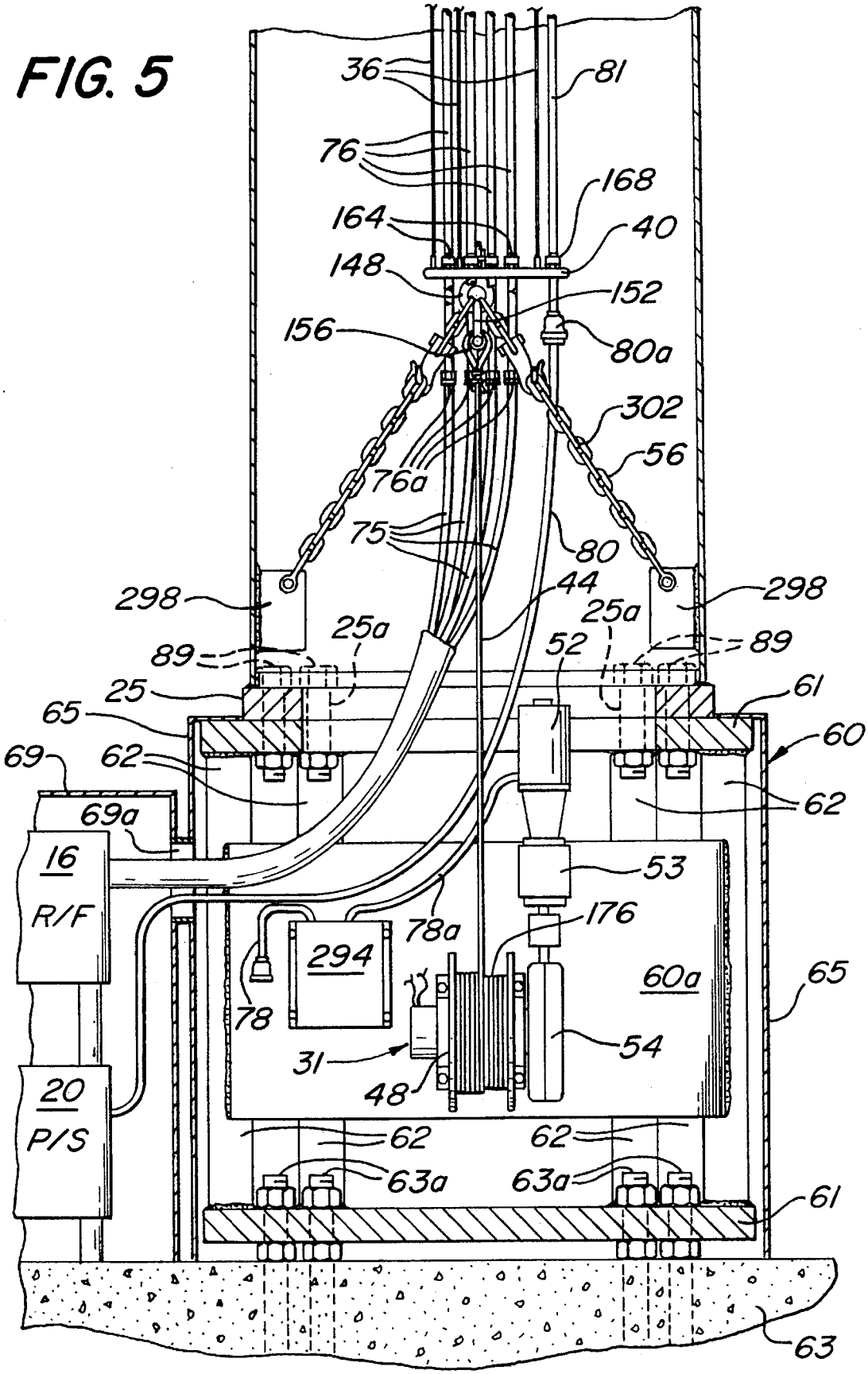
FIG. 5 is an enlarged sectional view illustrating the interior of the lower portion of the mast pole and the interior of the base assembly of the preferred embodiment of the present invention.

The various major components of the preferred embodiment 10 of the system invention are shown herein in FIGS. 1A and 5 and basically comprise the heretofore identified mast pole (FIG. 1A), a headframe assembly 28 (FIG. 1A) comprising various roller compartments 184, 188, 192 mounted on a base 100 (FIG. 1A), a platform assembly 32 (FIG. 1A), a plurality of lift cables 36 (FIGS. 1A and 5), a transition assembly 40 (FIG. 5), a winch cable 44 (FIG. 5), a winch assembly 48 (FIG. 5), an internal motor 52 (FIG. 5), an in-line reducer 53 (FIG. 5), a right angle reducer 54 (FIG. 5), a frequency inverter 294 (FIG. 5), a bottom latching assembly 56 (FIG. 5), a base assembly 60 (FIG. 5), a plurality of the heretofore identified antenna cylinders 64 (FIG. 1A) for housing the antennae 12 and a plurality of luminaire cylinders 68 (FIG. 1A) for housing luminaires, a cabinet 69 adjacent the base assembly 60 for housing power supplies 20 and radio frequency equipment 16 (FIG. 5).

Figure 2:
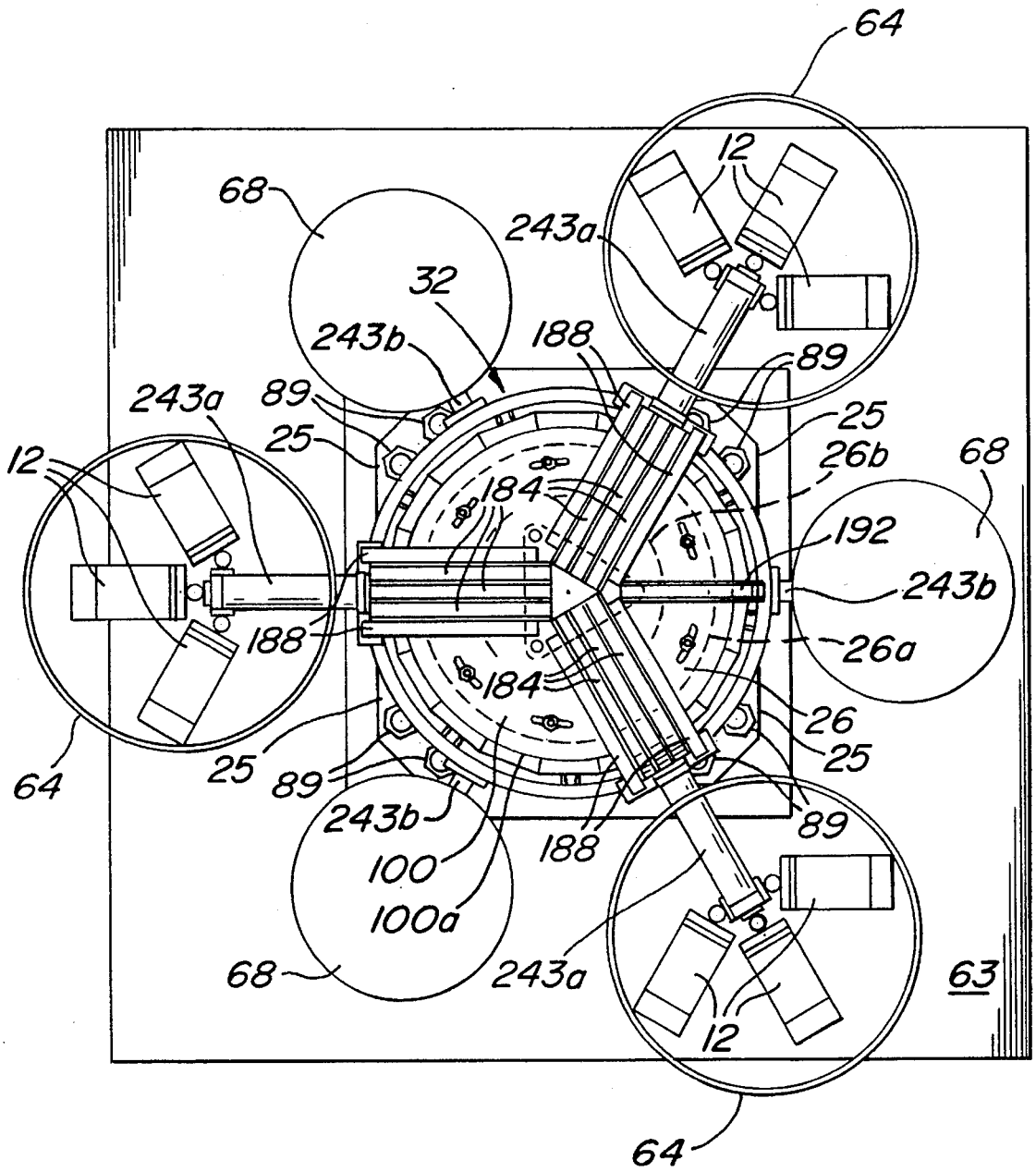
FIG. 2 is an enlarged sectional view taken along line 2—2 of FIG. 1.
Figure 4:
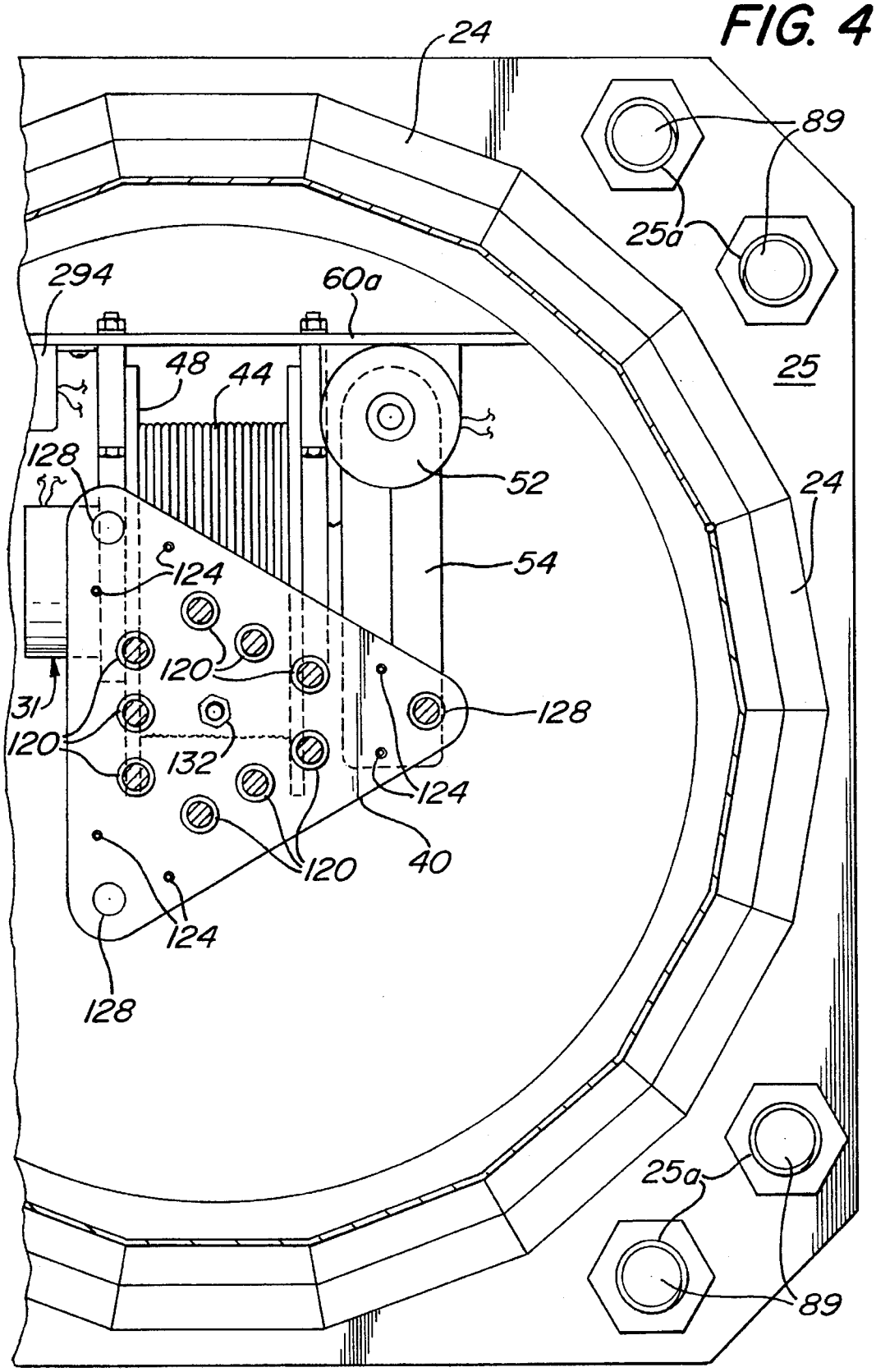
FIG. 4 is an enlarged sectional view taken along line 4—4 of FIG. 1.

Referring now to FIGS. 1, 2 and 4, the mast pole shaft 24 is a hollow member open at both ends, and is provided with a horizontally disposed base flange 25 and a circular top flange 26 welded to said shaft 24. The top flange has an outer edge **26*a* and an inner flange 26*b*. As shown in FIGS. 4 and 5 the base flange 25 is provided with through openings 25*a* to facilitate attachment of the mast pole shaft 24 to the base assembly 60. The mast pole shaft 24 is fabricated from a plurality of hollow metal mating segments that fit into each other to form an overlap telescoping joint. The segments are joined together to achieve the overall desired height, typically around one-hundred feet. The tapered mating segments of the mast pole shaft 24 may be fabricated from galvanized steel or weathering steel or any other suitable material. The mast pole shaft 24** maintains a uniform taper over its entire length from bottom to top.

As shown in FIGS. 1 and 5, the base portion 25 of the mast pole shaft 24 is connected to the top of base assembly 60 by any conventional means, e.g., bolts 89. Referring now to FIG. 5, the base assembly 60 comprises a pair of horizontally positioned opposed base plates 61 that are separated by a plurality of pipes 62 that extend therebetween. The base assembly 60 is affixed to a concrete pad 63 by any conventional means known to those practiced in the art, e.g., attachment to bolts 63a extending upwardly from said concrete pad 63. The open area defined between the base plates 61 of base assembly 60 is utilized to house various components of the preferred embodiment including an internal motor 52, winch assembly 48, gear reducers 53 and 54, and frequency inverter 294. These components are mounted to a base mounting plate **60*a* within base assembly 60 by any suitable conventional means. Additionally, the base assembly 60 is provided with covers 65** to protect the components mounted therein from the outside environment.

In accordance with the preferred embodiment of the present invention, it is often a design choice to position various components of telecommunications equipment, e.g., radio frequency equipment 16 and power supplies 20, at ground level rather than at an elevated position on the mast pole due to the fact that such equipment is quite expensive. In accordance with this preferred embodiment, these components, i.e., radio frequency equipment 16 and power supplies 20, are housed within a cabinet 69 adjacent the base assembly 60. A conduit **69*a* provides access between cabinet 69 and the base assembly 60 to enable the routing of various cables from the power supply 20 and radio frequency equipment 16 housed within cabinet 69 into the base assembly 60**.

Power is delivered to other equipment, e.g., an obstruction light (not shown), the luminaires or any other platform mounted equipment requiring power by means of a power cable 80 which extends from the power supply 20 located in housing 69 through a conduit **69*a* and upwardly through the bottom portion of the mast pole shaft 24. When the platform assembly 32 is in the raised position, the power cable 80 is detachably connected to a power cable 81 by means of a connector 80*a*. When it is desired to lower the platform assembly 32 to a position for servicing, the power cable 80 is detached from connector 80*a* and connected to a connector located at the free end of the power cable 78. The other end of cable 78 is connected to one side of a frequency inverter 294. The other side of the inverter is connected via a cable 78*a* to a motor 52. Thus the motor 52 is provided with power by the connection of the power cable 80 to cable 78, through the inverter 294 and through cable 78*a***.

The power cable 81 extends through a transition assembly 40 and upwardly through the mast pole shaft 24 and connects at its second end to the equipment, e.g., an obstruction light, mounted on platform assembly 32. Likewise, a plurality of coaxial signal cables 75 connect at their first ends to the radio frequency equipment 16 housed within cabinet 69 and extend in a bundle through the conduit **69*a* and connect at their second ends to coaxial signal cables 76 by means of detachable connectors 76*a*. The signal cables 76 extend through the transition assembly 40 and upwardly through the open interior of mast pole shaft 24 and connect at their second ends to the antennae 12 mounted on the platform assembly 32**.

Referring now to FIGS. 4 and 5, it can be seen that the transition assembly 40 of the preferred embodiment is located in the lower portion of the mast pole shaft and is generally triangular in shape. It may be fabricated from any suitable material, e.g., galvanized plate steel. As shown in FIG. 4, the transition assembly 40 is provided with a plurality, e.g., nine, threaded coaxial cable openings 120, a plurality, e.g., six, lift cable openings 124, and a plurality, e.g., three, threaded power cable openings 128, and a centrally located winch cable opening 132. It should be understood that the number of openings shown in the transition assembly of the preferred embodiment is exemplary only and a greater or lesser number of openings or a different arrangement of openings may be specified in accordance with customer requirements without departing from the spirit of this invention. Six lift cables 36 are shown passing through each of the six lift cable openings 124 of transition assembly 40. The lift cables 36 are secured to transition assembly 40 by any suitable means of attachment, e.g., attaching hardware including thrust bearings, hex nuts and nylon stop nuts (not shown). The lift cables 36 extend upwardly through the interior of mast pole shaft 24 toward head frame assembly 28. Nine coaxial cables 76 are shown extending through coaxial cable openings 120 of transition assembly 40 and extending upwardly through the interior of the mast pole shaft 24 toward the headframe assembly 28.

The coaxial signal cables 76 are gripped within the coaxial cable openings 120 of the transition assembly 40 by any suitable means, e.g., strain relief cable grips 164, that install within the threaded coaxial cable openings 120. The strain relief cable grips 164 may be of any suitable construction. One particularly effective design cable grip 164 is sold under the registered trademark KELLEMS manufactured by Hubbel Incorporated of Bridgeport, Conn. A power cable 81 passes through the power cable opening 128 of the transition assembly 40 and extends upwardly through the interior of the mast pole shaft 24 toward the headframe assembly 28. The power cable 81 is gripped within the opening 128 of the transition assembly 40 by any suitable means, e.g., a strain relief cable grip 168 (like those previously discussed in connection with the coaxial signal cables and suitably sized for the outside diameter of the power cable 81).

Still referring to FIGS. 4 and 5, the winch cable opening 132 of transition assembly 40 is provided with hardware, e.g., an eyebolt 148, to provide a point of attachment for a winch cable 44 to the transition assembly 40 by means of a round pin anchor shackle 152. The winch cable 44 is coiled over winch drum 176 of winch assembly 48 and one end is secured to the drum. The free end of the winch cable 44 is provided with a thimble 156 which is attached to the free end of the winch cable by conventional means, e.g., a cold-swaged compression sleeve to permit attachment to eyebolt 148. The winch cable 44 may be fabricated from any suitable material, e.g., stainless steel 7×19 strand 5/16" diameter aircraft cable, type 303/304. The winch cable 44 is of sufficient length to maintain at least four complete wraps on the winch drum 176 when the platform assembly 32 has been lowered to its lowest position. The winch drum 176 is provided with conventional "keepers" (not shown) to guide the unwound portion of winch cable 44 uniformly onto the drum 176 during winding. The operation of the winch assembly 48 is effected by the motor 52. The motor 52 can be of any suitable construction that will produce the torque necessary for raising and lowering the load of the platform assembly 32, the antennae 12 and other equipment mounted on platform assembly 32. The motor 52 includes a switch that enables it to operate in either the forward or reverse directions for raising and lowering of platform assembly 32. One particularly effective motor that can generate sufficient torque to hoist the load previously described is manufactured by Leeson Electric Corp. of Grafton, Wis.

In order to achieve an appropriate speed of ascent and decent of the platform assembly 32 during its raising and lowering and to achieve appropriate torque, the internal motor 52 is connected to the winch drum 176 through an in-line gear reducer 53 and a right-angle gear reducer 54. The reducers 53 and 54 serve to reduce the revolutions per minute from motor 52 to the winch drum 176. The reducers 53 and 54 may be of any suitable construction. Particularly effective in-line and right-angle reducers are manufactured by Winsmith Corporation of Springville, N.Y. In the preferred embodiment, the motor 52 has a rated output of 1750 revolutions/minute. It should be understood that in accordance with an aspect of this invention to be discussed later in this specification, the motor 52 may be controlled to operate at lower or higher speeds, thus making it possible to control the rate of ascent/decent of platform assembly 32 along the mast pole 24. The in-line reducer 53 provides a gear reduction ratio of 8:1, while the right angle reducer 54 provides an additional gear reduction ratio of 36:1. Thus, the winch drum 176 rotates at approximately six revolutions per minute. It should be understood that the gear reduction ratios set forth in this specification are exemplary and different types of gear reducers having different gear reduction ratios may be utilized without departing from the spirit of this invention.

As shown in FIG. 1A, the headframe assembly 28 is mounted atop the mast pole assembly 24. The headframe assembly 28 of the preferred embodiment comprises a base plate 100, a plurality of coaxial cable roller compartments 184, a plurality of lift cable roller compartments 188, and a power cable roller compartment 192.

Figure 3:
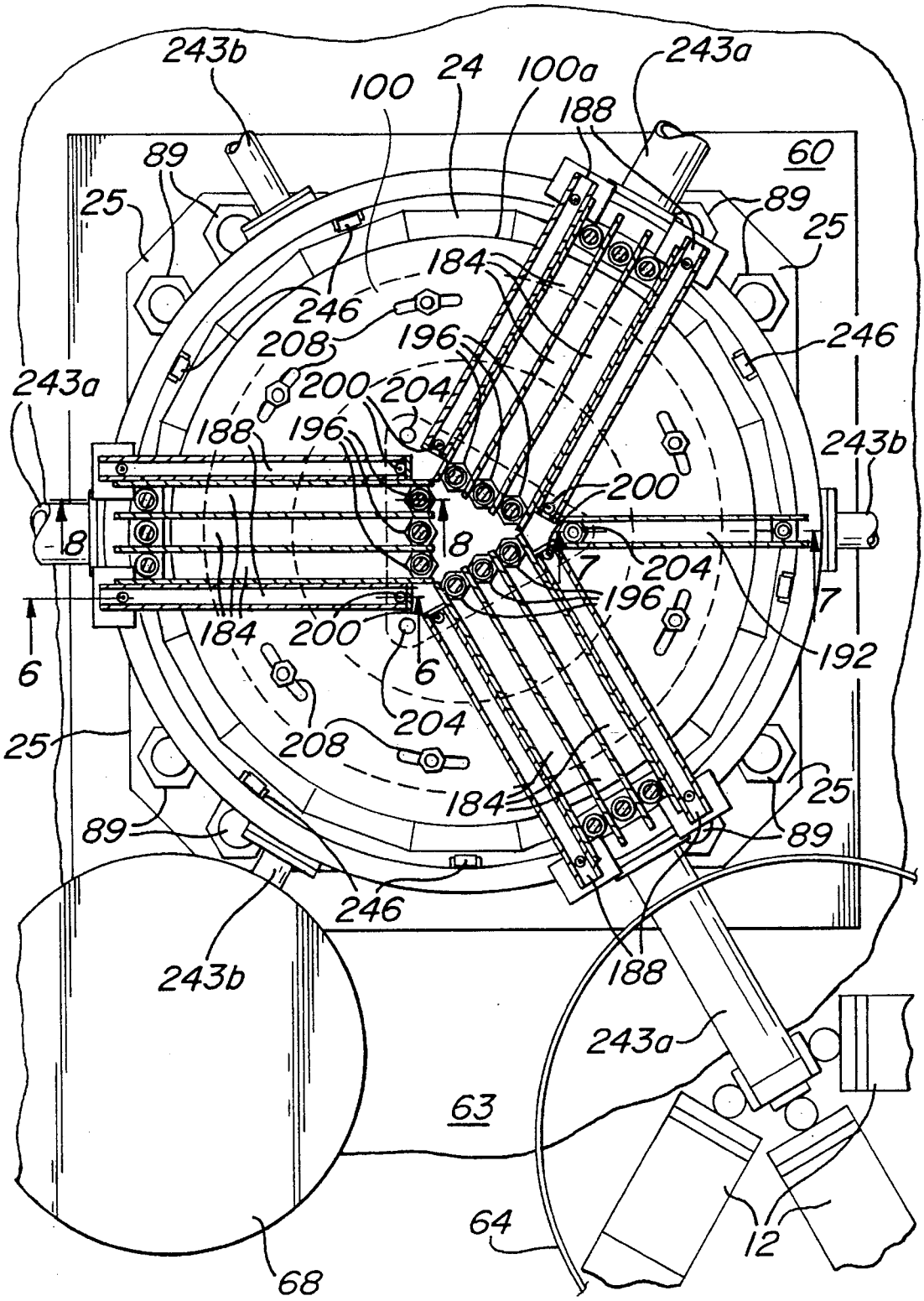
FIG. 3 is an enlarged sectional view taken along line 3—3 of FIG. 1.

As can be seen in FIG. 3, the base plate 100 of headframe assembly 28 is generally circular in shape and may be fabricated from a galvanized metal, such as sheet steel or other suitable material. The base plate 100 is provided with a centrally located manifold portion that comprises a plurality, e.g., nine, coaxial cable openings 196, a plurality, e.g., six, lift cable openings 200 and a plurality, e.g., three, power cable openings 204. It should be understood that the number of openings shown in the base plate 100 of the preferred embodiment is exemplary only and a greater or lesser number of openings or a different arrangement of openings may be specified in accordance with customer requirements without departing from the spirit of this invention. Each of the openings in the base plate 100 is located to correspond to the plurality of coaxial cable openings 120, lift cable openings 124, and power cable openings 128, respectively, located on transition assembly 40.

Each of the coaxial cable openings 196 in the base plate 100 provides a means for guiding a respective one of the plurality of coaxial signal cables 76 as they extend upwardly from transition assembly 40 and into each of the coaxial cable roller compartments 184. Likewise, each power cable opening 204 located in the base plate 100 provides guidance for one power cable 81 as it extends upwardly from transition assembly 40 and into each of the power cable roller compartments 192. Similarly, each lift cable opening 200 located in the base plate 100 provides similar guidance for a lift cable 36 as it extends upwardly from transition assembly 40 into each of the lift cable roller compartments 188. It should be understood that the number of openings provided in base plate 100 in connection with the preferred embodiment 10 is merely exemplary. A greater or fewer number of these openings may be specified for particular applications without departing from the spirit of this invention.

As can be seen in FIGS. 2 and 3 the base plate 100 is also provided with a plurality of slotted through openings 208. The openings enable attachment of the base plate 100 to the top flange 26 of mast pole assembly 24 by any conventional means, nuts and bolts. The through openings 208 are slotted to enable rotation of base plate 100 in order to achieve precise spatial orientation of the antennae 12.

Figure 11:
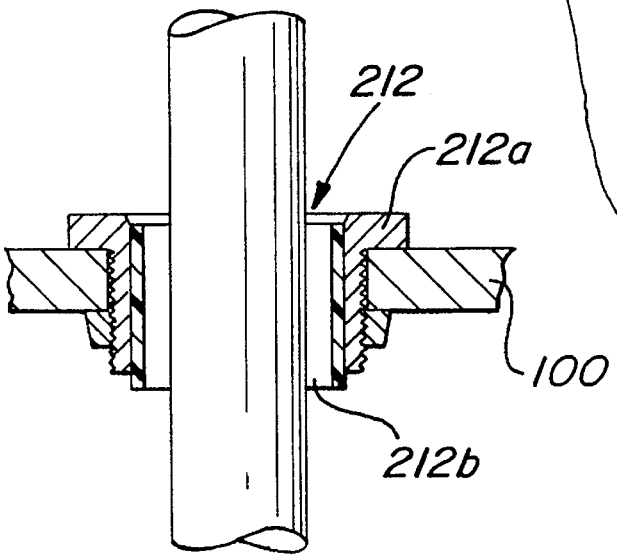
FIG. 11 is an enlarged sectional view of one of the plurality of through openings located in the manifold portion of the base plate of the headframe assembly shown in FIG. 3. The exemplary through opening is shown fitted with a cylindrical bushing.

Referring now to FIG. 11, there is shown a cross-section view of a through opening that is exemplary of the plurality of coaxial cable openings 196 and power cable openings 204 located in the base plate 100 shown in FIG. 3. The exemplary through opening shown in FIG. 11 is fitted with a cylindrical bushing 212 having a steel outer shell **212*a* and having a captive soft durable plastic interior 212*b*. An exemplary cable, e.g., either coaxial or power, is shown passing through the center of said bushing 212. The purpose of bushing 212 is to minimize friction and protect the outer jacket of the coaxial and power cables as they travel therethrough during the raising and lowering of platform assembly 32. More importantly, the bushings 212 provide guidance for each of the coaxial cables 76 and power cables 81 as they pass through base plate 100 during raising and lowering. The bushing 212 may be of any suitable construction. One particularly effective bushing is manufactured by Thomas and Betts under the name Insulated Chase Nipple. The inside diameter of the bushing is sufficiently large to enable free movement of the coaxial cable 76 or power cable 81** travelling therethrough.

FIGS. 1A, 2 and 3 illustrate the orientation of each of the various roller compartments 184, 188, 192 on base plate 100. Each of the signal cable roller compartments 184 has a first end oriented over one of the signal cable openings 196 situated at the manifold portion of base plate 100 and a second end extending over the outer edge **100*a* of the base plate 100. Likewise, each of the lift cable roller compartments 188 has a first end oriented over one of the lift cable openings 200 situated at the manifold portion of base plate 100 and a second end extending over the outer edge 100*a* of the base plate 100. The power cable roller compartment 192 similarly has a first end oriented over one of the power cable openings 204 situated at the manifold portion of the base plate 100 and a second end extending over the outer edge 100***a* of said base plate 100. It should be understood that although only one power cable roller compartment 192 is shown in the preferred embodiment, additional power cable roller compartments could be provided in accordance with this invention. Additionally, a greater or smaller number of lift cable roller compartments 188 and signal cable roller compartments 184 could be provided based upon the number of antennae 12 being utilized on platform assembly 32 and the amount of equipment requiring power situated on platform assembly 32.

Referring again to FIG. 3, the orientation of the signal cable roller compartments 184, lift cable roller compartments 188 and power cable roller compartment 192 on the base plate 100 is illustrated. As shown therein, the coaxial cable roller compartments 184 are disposed on base plate 100 in three groups. Each group of three compartments 184 is oriented 120 degrees with respect to the other two groups of three coaxial cable roller compartments 184. It should be understood that the orientation of the various roller compartments on base plate 100 as shown in the preferred embodiment is exemplary. Other orientations could be utilized without departing from the spirit of this invention.

Figure 8:
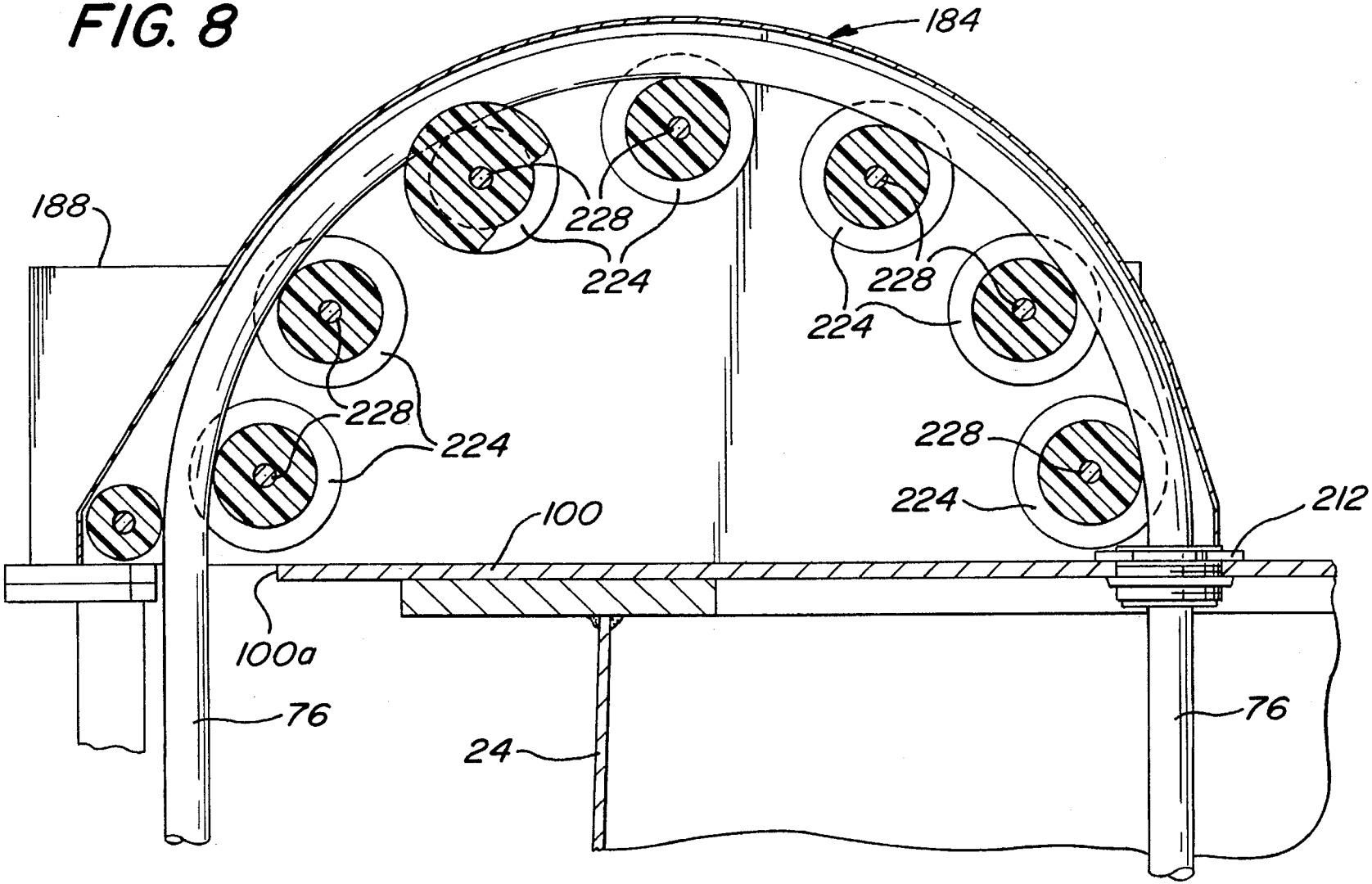
FIG. 8 is an enlarged sectional view taken along line 8—8 of FIG. 3.
Figure 9:
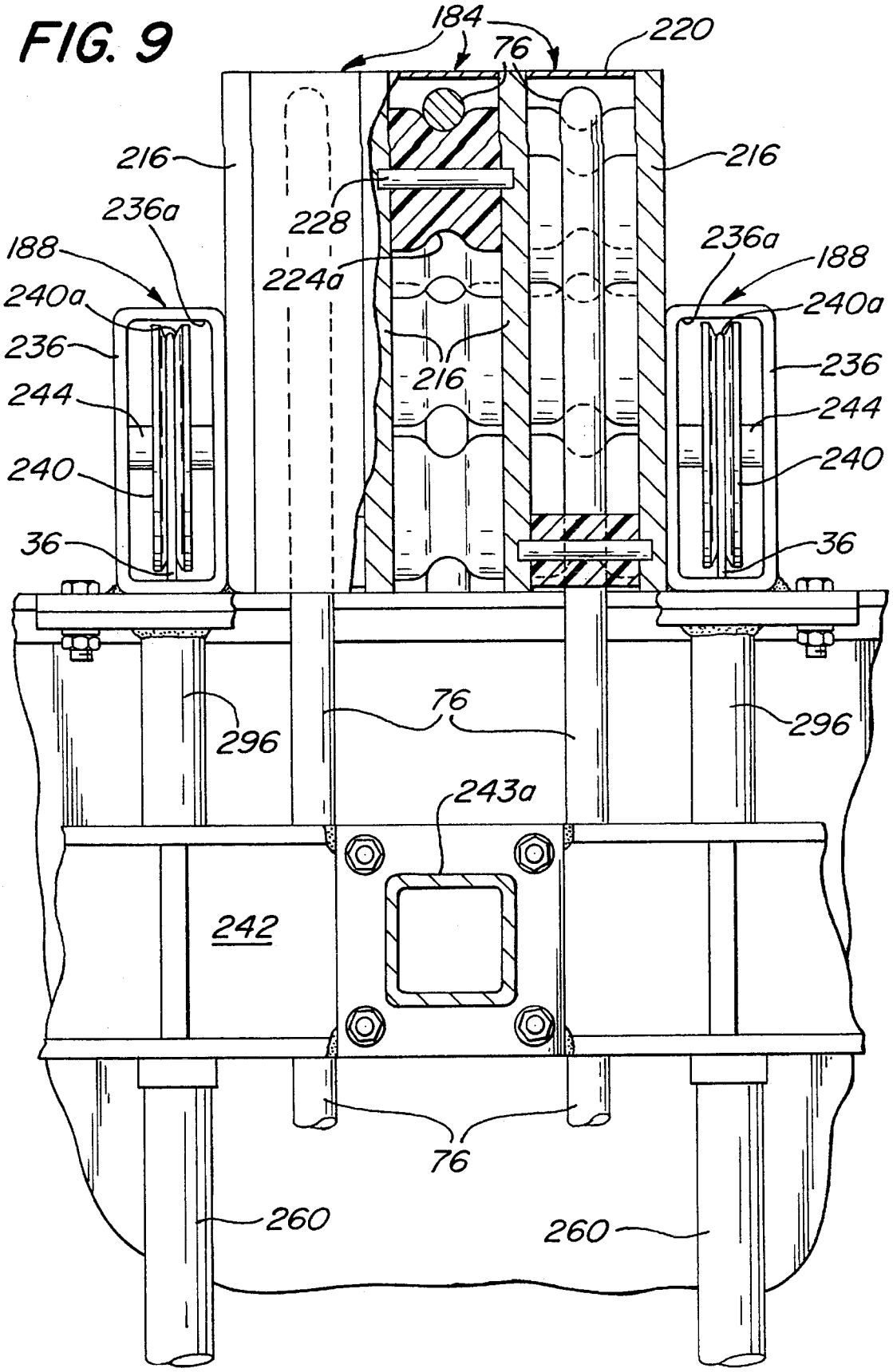
FIG. 9 is an enlarged sectional view taken along line 9—9 of FIG. 6.

The details of each of the coaxial cable roller compartments 184 is illustrated in FIGS. 8 and 9. Referring now to FIG. 9, each coaxial cable roller compartment 184 comprises two opposed semi-circular side plates 216 and a top plate 220 that form an enclosed compartment. Two adjacent compartments may share a common side plate 216. The compartment side plates 216 may be fabricated from galvanized sheet steel or similar material and may be secured to the base plate 100 by means of L-brackets and bolts (not shown) or by other conventional fastening means. Referring again to FIG. 8, disposed within the enclosed compartment 184 are a plurality, e.g., seven, free turning cable rollers 224. The cable rollers 224 are spaced sufficiently apart from one another and from the top plate 220 to enable a signal cable 76 of a particular diameter to travel and be supported between the cable roller 224 and the top plate 220 during the raising and lowering of the platform assembly 32. Typically, the coaxial type signal cables 76 utilized in accordance with the present invention have a diameter of ⅞ inches or greater. The coaxial cable is relatively inflexible or stiff. Accordingly, cable manufacturers specify a recommended bend radius based upon a particular diameter that is not to be exceeded in order to prevent early degradation of the cable. For example, manufacturers suggest that a coaxial cable having a diameter of ⅞ inches should maintain a bend radius of no less than eight inches. In order to maintain such a bend radius and prevent degradation of the coaxial cable, in accordance with manufacturers recommendations, the cable rollers 224 are positioned within the roller compartment 184 in a manner that enables the coaxial cable 76 to travel thereover and maintain that bend radius. Each cable roller 224 within the coaxial cable roller compartment 184 is fabricated from polyvinyl chloride or a similar low friction material to facilitate movement of the coaxial cable 76 thereon and to minimize tension and friction as the cable 76 moves along the roller 224 during the raising and lowering of platform assembly 32.

Referring to FIG. 9, it can be seen that the outer periphery of each cable roller 224 is in the form of a groove 224*a* to accept the outer diameter of a coaxial cable 76 having a particular thickness. The cable rollers 224 are mounted between the side plates 216 by means of stainless steel axles 228.

Figure 7:
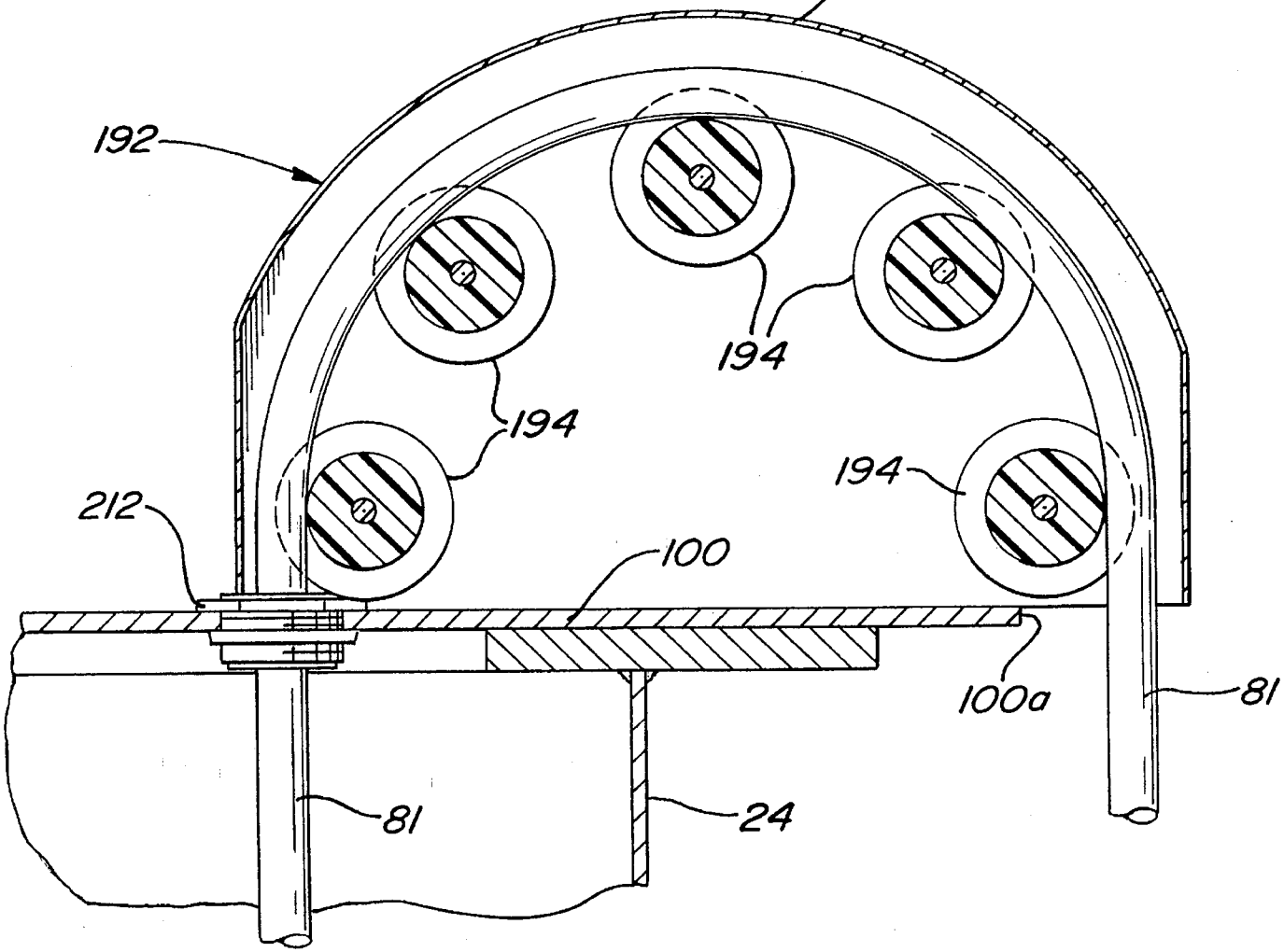
FIG. 7 is an enlarged sectional view taken along line 7—7 of FIG. 3.

The details of the power cable roller compartment 192 are illustrated in FIGS. 1A and 7. Similar to the signal cable roller compartment 184, each power cable roller compartment 192 comprises two opposed semi-circular side plates and a top plate 193 to form an enclosed compartment. The power cable roller compartment side plates may be fabricated from galvanized sheet steel or similar material and may be secured to the base plate 100 by means of L-brackets and bolts (not shown) or by other conventional fastening means.

Referring again to FIG. 7, disposed within the compartment 192 are a plurality, e.g., five, free turning cable rollers 194. The cable rollers 194 are spaced sufficiently distant from one another and from top plate 193 to enable a power cable 81 of a particular diameter to travel and be supported between cable roller 194 and top plate 193 during the raising and lowering of platform assembly 32. Additionally, the cable rollers 194 are positioned within the roller compartment 192 in a manner that enables the power cable 81 to travel thereover and maintain the bend radius as previously discussed in connection with coaxial cables. Similarly, each cable roller 194 is fabricated from polyvinyl chloride or a similar low friction material to facilitate movement of the power cable 81 thereon and to minimize tension and friction as the cable 81 moves along the roller 194 during the raising and lowering of platform assembly 32. Additionally, the periphery of each of the cable rollers 194 is of a grooved shape to accept a power cable 81 having a particular thickness.

Figure 6:
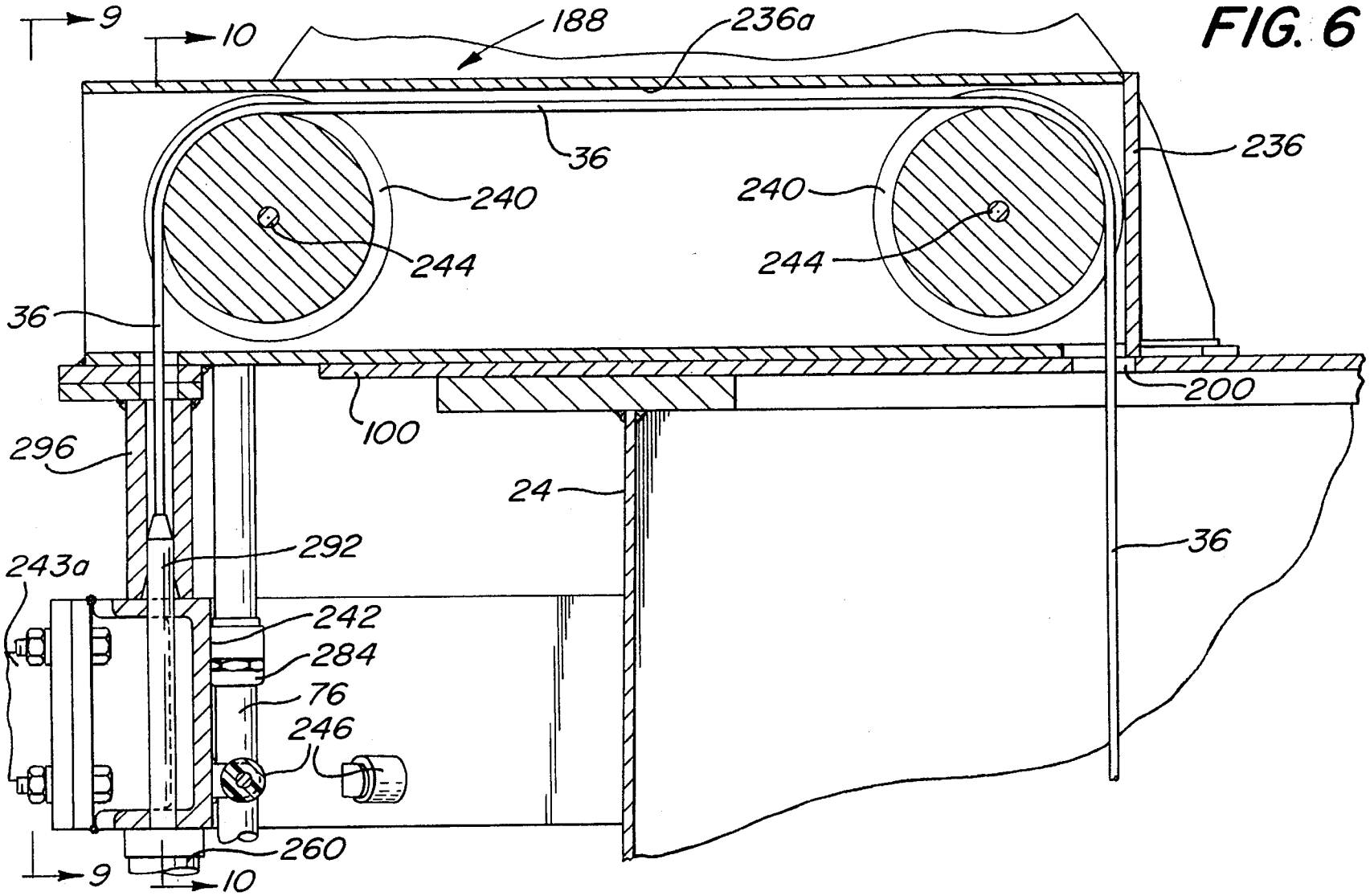
FIG. 6 is an enlarged sectional view taken along line 6—6 of FIG. 3.

The details of the lift cable roller compartment 188 is illustrated in FIGS. 6 and 9. Referring thus to FIG. 9, it can be seen that each lift cable roller compartment 188 is fabricated from structural rectangular tubing 236 having two open ends and defining a compartment therein. In the preferred embodiment, two pulleys 240 are mounted within the compartment 188 by means of stainless steel axles 244. The outer periphery of each of the pulleys 240 is in the form of a groove 240*a* to accept the thickness of the lift cable 36 to prevent the lift cable 36 from degradation, i.e., being flattened or crushed. As shown in FIG. 6, each pulley 240 is positioned within close tolerance near the inside top surface 236*a* of a rectangular tube 236. In this manner, inside top surface 236*a* of the rectangular tube 236 serves to prevent a lift cable 36 from jumping out of the groove 240*a* of the associated pulley 240 during operation. In other words, the inside top surface 236*a* of rectangular tubing 236 serves as a "keeper" for the lift cable 36. Each lift cable 36 extends upwardly from the lift cable opening 200 in base plate 100, over pulleys 240 within the lift cable roller compartment 188 and thereafter extends downwardly exiting the lift cable roller compartment 188. Once the lift cable 36 has exited the lift cable roller compartment 188, it extends through a downwardly facing guide pin receptacle 296 that is attached to the underside of each lift cable roller compartment as shown in FIGS. 1, 6, 9 and 10. The purpose of the guide pin receptacle 296 will be explained in detail later in this specification. Thereafter, each lift cable 36 extends downwardly along the outside of mast pole shaft 24 toward platform assembly 36.

Referring to FIGS. 1A, 6 and 9, the platform assembly 32 is shown surrounding the mast pole shaft 24 and comprises a generally circular center platform assembly 242, a plurality of antenna mounting arms 243*a* and a plurality of luminaire mounting arms 243*b* extending outwardly radially from the center platform assembly 242. As shown in FIG. 9, the three antenna mounting arms 243*a* are equidistantly spaced from one another around center platform assembly 242 at approximately one-hundred twenty degree distances and the three luminaire mounting arms 243*b* are similarly spaced from one another around center platform assembly 242. The arms 243*a* are connected to the center platform assembly 242 by any conventional means, e.g., attachment by nuts and bolts to a plate welded to center platform assembly 242 (FIGS. 6 and 9). The arms 243*b* are attached in a similar manner. The center platform assembly 242 and arms 243*a* and 243*b* may be fabricated from any suitable material, e.g., galvanized pipe, tube or plate steel. It should be understood that the platform assembly 32 being described in connection with the preferred embodiment is exemplary and a greater or fewer number of antenna and/or luminaire arms may be specified based upon the application without departing from the spirit of this invention. Further, the positioning of the luminaire and antenna mounting arms around the center platform assembly 242 as discussed herein is exemplary and different locations and distances for these arms could be specified without departing from the spirit of this invention.

Referring to FIGS. 1A and 3, it can be seen that the inside surface of the center ring 242 is provided with a plurality of rollers 246 to protect the platform assembly 32 and mast pole shaft 24 during raising and lowering thereof.

Figure 10:
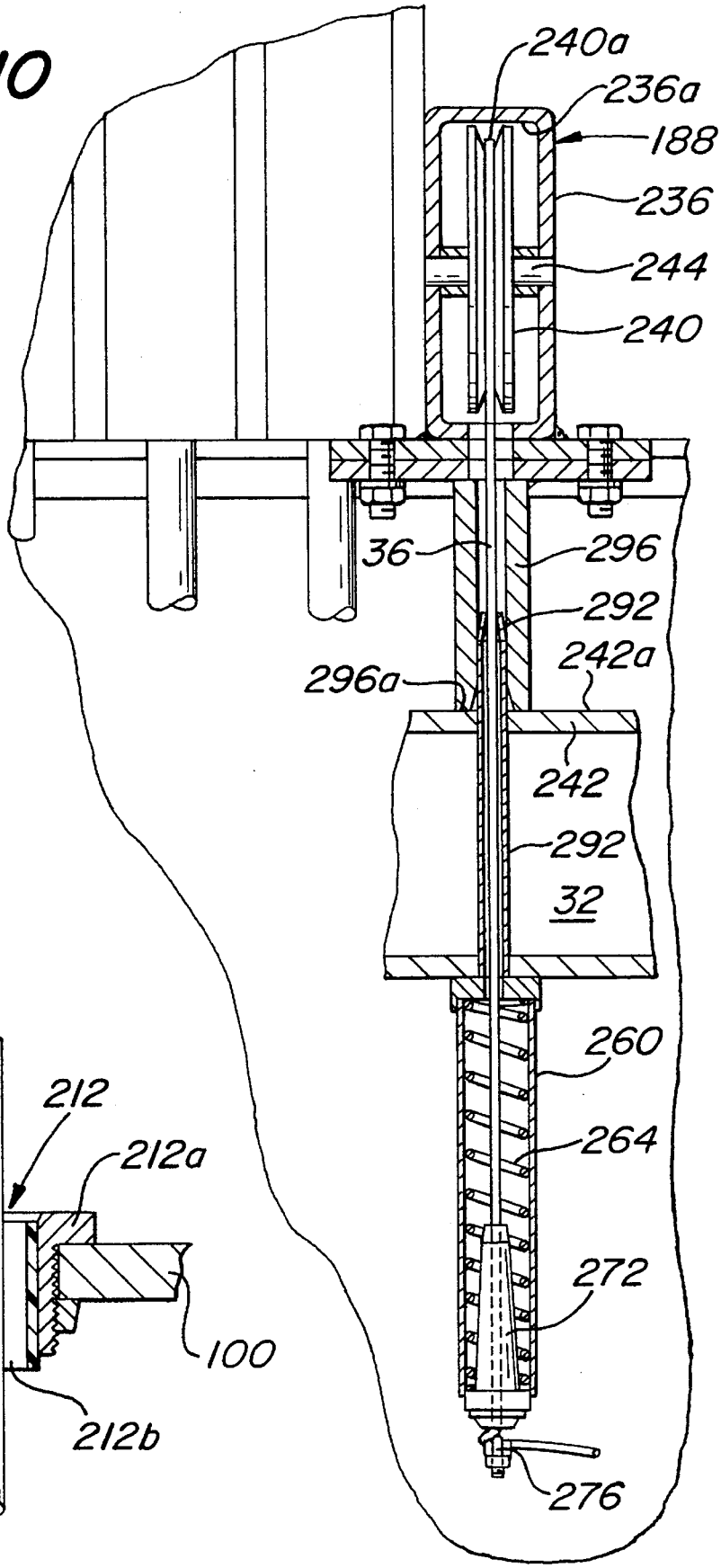
FIG. 10 is an enlarged sectional view taken along line 10—10 of FIG. 6.

Referring now to FIGS. 1A and 10, the platform assembly 32 is also provided with a plurality of spring housings 260, that are attached about the lower surface of center ring 242 and extend downwardly from platform assembly 32. Each spring housing contains a compression spring 264 (FIG. 10). The platform assembly 32 is suspended around the mast pole shaft 24 by means of the lift cables 36. These cables which extend downwardly from the headframe assembly 28 and pass through upwardly facing guide pins 292 and the spring housings 260. The purpose of the upwardly facing guide pins 292 will be discussed later in this specification. As shown in FIG. 10, the lift cables 36 are held within the spring housings 260 by means of an adapter 272 extending within a compression spring 264 and a wire rope clip 276 attached to the end of each lift cable 36 exiting from spring housing 260.

Repeatability of operation is an extremely important aspect of the raise/lowering systems for communications equipment. "Repeatability" as used herein means the ability of a raise/lowering system to raise antennae 12 to a position and orientation that is identical to that occupied by them prior to lowering of platform assembly 32 for servicing. As shown in FIGS. 1A and 10, in order to achieve a high degree of repeatability, a plurality, e.g., six, upwardly projecting guide pins 292 (mentioned previously), are provided opposite each of the spring housings 260 on the platform assembly 32. Additionally, a plurality of corresponding downwardly facing guide pin receptacles 296 (mentioned previously) are provided on the underside of each of the six lift cable roller compartments 188.

Referring to FIG. 10, the lift cables 36 are disposed through respective ones of the guide pin receptacles 296 and the guide pins 292. As the platform assembly 32 reaches the elevated position, each guide pin 292 enters the hollow opening within the corresponding guide pin receptacle 296 and the top surface 242*a* of center platform assembly 242 abuts the end surface 296*a* of the guide pin receptacle 296. Entry of the guide pins 292 into the guide pin receptacles 296 assures proper orientation of antennae 12, thus ensuring a high degree of repeatability. Once the top surface 242*a* of center ring 242 abuts the end surface 296*a* of the guide pin receptacle, the platform assembly is in the "elevated" or "operational" position.

The system of the present invention is provided with an internal motor shut-off means, e.g., a frequency inverter 294, for shutting off the motor 52 once the platform assembly 32 has reached the operational position. Referring again to FIG. 10, in particular, there is shown a large compression spring 264 housed within each of the spring housings 260 situated around the underside of center platform assembly 242. As the platform assembly 32 reaches the operational position, the lift cables continue to be drawn in by the operation of the motor 52. This results in the exertion of a force on the compression springs 264 within the housing 260. The compression springs 264 thus begin to compress and create a resistive force requiring greater torque from the motor 52. In order for the motor 52 to continue to raise the platform assembly 32, it must draw increasing amounts of current to produce greater amounts of torque.

It is possible that the motor 52 may draw current at a rate that exceeds its maximum rating. Such an increase in the rate of current being drawn by the motor 52 can result in damage to it and the various components of system 10. In order to prevent much damage the heretofore identified frequency inverter 294 is provided. In particular, the frequency inverter 294 is arranged to detect the rate of current being drawn by the motor 52 and cease supplying current to the motor 52 once a predetermined threshold rate of current has been exceeded. One particularly effective frequency inverter 294 is sold under the name 8200 Frequency Inverter Series 0.37–2.2 kW manufactured by Lenze Antriebstechnik. The use of a frequency inverter 294 in combination with a raise/lowering device is a significant improvement over the prior art use of a mechanical clutch because it is capable of detecting and governing current being drawn by motor 52, whereas a mechanical clutch measures torque being applied by drive shaft of the motor 52. Since the frequency inverter 294 is an electronic device, it is much more accurate and reliable than the mechanical clutch and maintains calibration much longer.

The frequency inverter 294 is also programmable to enable it to govern the amount of current being drawn by the motor 52. This feature is of considerable importance in accordance with another aspect of this invention. In particular, it enables one to govern the speed at which the motor 52 rotates and thus governs the speed at which platform assembly 32 ascends and descends along the mast pole 24. In this regard, telecommunications equipment being raised and lowered by the device of this invention is extremely expensive, often costing hundreds of thousands of dollars. This is in contrast to lighting systems mounted on raise/lowering devices which cost only hundreds of dollars per luminaire. In order to protect this expensive telecommunications equipment from damage, it is desirable to slow the movement of platform assembly 32 along mast pole shaft 24 as it approaches the elevated position, e.g., within a zone of ten feet from the elevated position. Likewise it is desirable to slow the movement of the platform assembly 32 as it approaches the lowered servicing position, e.g., within a zone of ten feet from the lowered position. It is also desirable to have the platform assembly 32 move at a higher rate of speed when it is travelling between these two zones so as to reduce the overall time involved raising and lowering telecommunications equipment thereby minimizing the costs relating to providing service to this equipment.

Figure 16:
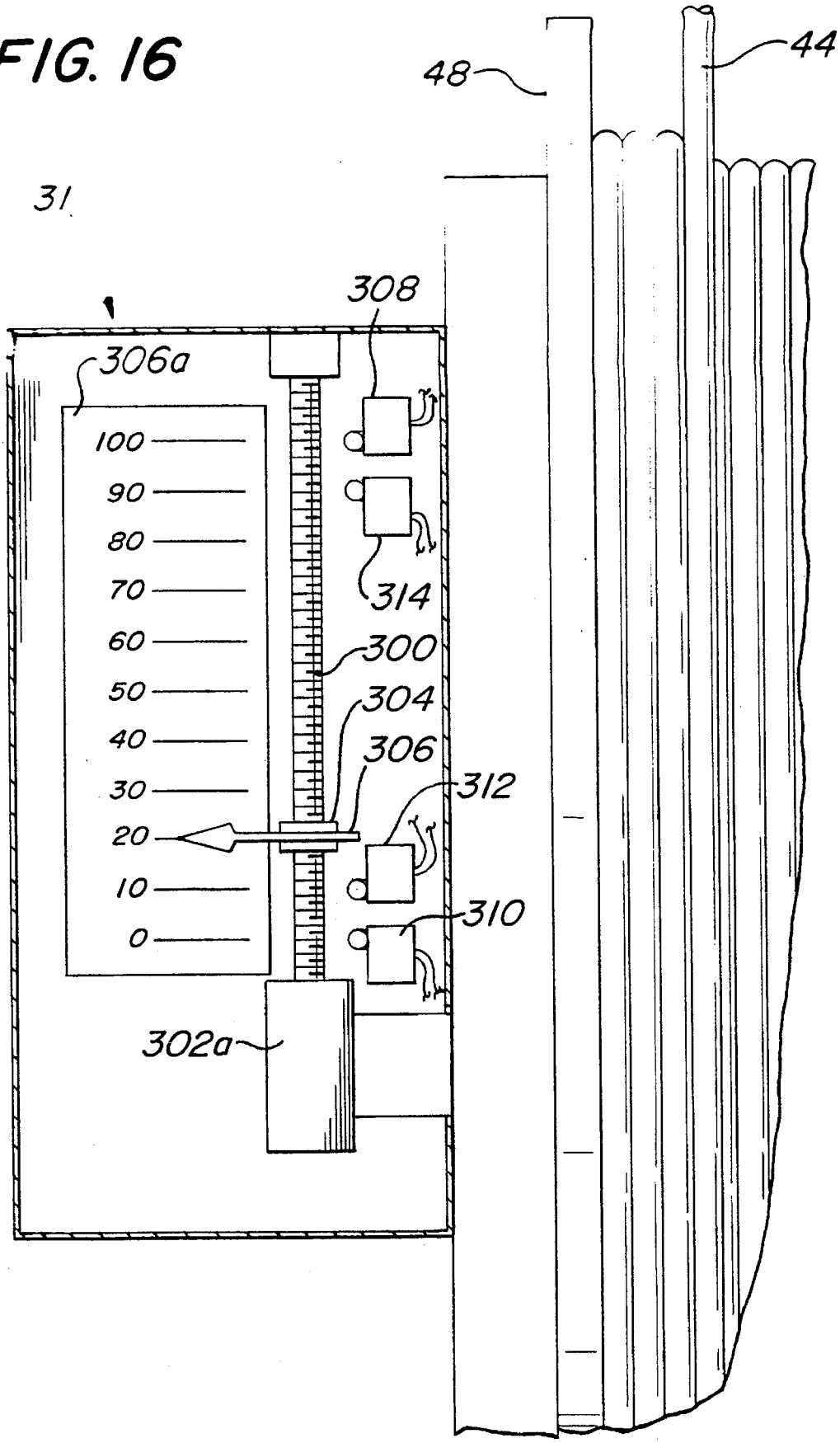
FIG. 16 is a detail elevational view, partially in section, of the means for controlling the speed of the platform assembly along the mast pole shaft.

To achieve those ends and, as shown in FIGS. 5 and 16, the system of the present invention includes speed governing apparatus 31 for governing the speed of ascent and descent of platform assembly 32 along mast pole shaft 24. In particular, as shown in FIG. 5, the speed governing apparatus of the present invention is housed within the base assembly 60 and comprises three components, namely, a means for determining the location of platform assembly 32 along mast pole shaft 24, switching means, and the heretofore identified frequency inverter 294.

The means for determining the location of platform assembly 32 on mast pole shaft 24 is shown in FIGS. 5 and 16. Referring now to FIG. 16, it can be seen that that means comprises an acme screw 300 having a threaded shank and a ball 304 having an internal threaded opening therethrough. The acme screw 300 is coupled to the free end of the axle (not shown) of the winch drum 176 by means of a right-angle gear reducer 302*a* having a reduction ratio of 1:1. The threaded shank of acme screw 300 has a predetermined length, e.g., ten inches, and a predetermined number of threads per inch, e.g., ten. The overall length of acme screw 300, e.g., ten inches, corresponds to the overall length of mast pole shaft 24.

The acme screw 300 is disposed through the internally threaded opening of the moveable ball 304. Mounted on the moveable ball 304 is an arrow indicator or pointer 306. As the axle of the winch drum 48 rotates in one direction, the acme screw 300 rotates in the same direction causing the ball 304 to travel in one direction along the threaded shank of acme screw 300 for a given distance. Conversely, when axle of winch drum rotates in the opposite direction, the ball 304 is caused to travel in the opposite direction. Each inch of length that ball 304 travels along threaded shank of acme screw 300 corresponds proportionately to a given number of feet of travel of platform assembly 32 along mast pole shaft 24. For example, each inch that ball 304 travels along the threaded shank of acme screw 300 may represent ten feet of travel of platform assembly 32 along mast pole shaft 24. A visual scale 306*a* represents numerically the height of mast pole shaft 24 in ten foot increments from zero to one hundred feet is provided adjacent the acme screw. Zero feet correspond to the lowered position for servicing and one-hundred feet correspond to the elevated position. The arrow 306 indicates the location of the platform assembly 32 on mast pole shaft 24 as it travels from the lowered position to the elevated position. As shown in FIG. 16, the platform assembly 32 is located approximately twenty-three feet up mast pole shaft 24.

A lower stop switch 310 is mounted adjacent the screw 300 at a position corresponding to the bottom of mast pole shaft 24. Thus, when lower stop switch 310 is tripped by the arrow indicator 306, the switch sends a signal to the frequency inverter 294 to stop supplying current to the motor 52. This causes the motor to cease operating, thus stopping the descent of platform assembly 32. Similarly, an upper stop switch 308 is mounted adjacent the screw 300 at a position corresponding to the top of the mast pole shaft 24. When the upper stop switch 308 is tripped by arrow indicator 306 the switch sends a signal to frequency inverter 294 to stop supplying current to the motor 52. This causes the motor to cease operating, thus stopping the ascent of platform assembly 32.

Additionally, upper 314 and lower 312 speed change limit switches are provided mounted adjacent the screw at locations adjacent acme screw 300 corresponding to positions near the top and near the bottom of mast pole shaft 24, e.g., ten feet from the top and ten feet from the bottom of mast pole shaft 24. Thus, the platform assembly 32 begins ascent from the lowered position, the frequency inverter 294 is initially programmed to run the motor 52 at a reduced speed, e.g., 1350 RPM. When the lower speed change limit 312 is tripped by the arrow indicator 306, a signal is sent therefrom to frequency inverter 294. In turn, the frequency inverter 294 adjusts the level of current being drawn by the motor 52 so as to increase the speed of the motor 52, e.g., from 1350 RPM to 1800 RPM, thus increasing the rate of ascent of platform assembly 32. When the upper speed change limit 314 is tripped by the arrow indicator 306, a signal is sent to frequency inverter 294 which in turn effects a decrease in speed of internal motor 52, e.g., from 1800 RPM to 1350 RPM, thus decreasing the rate of ascent. It should be understood that stop and limit switches can be placed at any position along acme screw 300 as required without departing from the spirit of this invention.

An alternative arrangement (not shown) for governing the speed of ascent and descent of platform assembly 32 on mast pole shaft 24 could also be implemented by positioning limit switches over the length of the mast pole shaft, the limit switches being arranged to send a signal to the frequency inverter 294 once the platform assembly 32 reaches the limit switch. This alternative arrangement is less desirable because the limit switches are on the outside surface of the mast pole shaft 24 and are thus exposed to the ambient weather conditions rather than being sheltered within the base assembly 60.

As shown in FIG. 1A, the coaxial cables 76 extend downwardly from the headframe assembly 28 and pass through a plurality, e.g., three, adjacent openings in the plate 284 connected to the inside surface of center platform assembly 242 opposite each arm 243*a*. The coaxial cables 76 are gripped within the openings by any suitable means, e.g., strain relief cable grips (not shown) that install within the openings of the plate 284. The strain relief cable grips 288 may be of any suitable construction, such as those mentioned previously in connection with transition assembly 40. Each coaxial cable 76 extends through a respective opening in plate 284 and is routed across an arm 243*a* and is attached to three antennae 12 mounted at the extended end of associated antenna mounting arm 243*a*. As shown in FIG. 2, a plurality, e.g., three, antennae are attached at the extended end of each antenna mounting arm 243*a*. It should be understood that the number of antennae being shown as attached at the extended end of each antenna mounting arm 243*a* is merely exemplary and any number of antennae may be mounted thereon without departing from the spirit of this invention. As shown in FIG. 2, antennae may be housed within optional antenna cylinder 64. Additionally, optional luminaire cylinders 68 are provided at the extended end of each arm 243*b* should it be desired or necessary to install luminaires (not shown) in addition to antennae 12. The power cable 81 is routed across the platform assembly 32 and is connected to equipment mounted thereon in a similar manner.

As shown in FIG. 5, the mast pole shaft 24 is provided with safety tie down plates 298. Once the platform assembly 32 has been raised to its elevated position after servicing, the transition assembly 40 is secured to the safety tie down plates 298 by means of chains 302. Each chain includes a pair of ends, one of which being connected to a ball bearing swivel 148 and the other end being connected to a safety tie down plate 298. This provides a safety back-up in the event that the winch cable 44 fails.

In operation, in order to lower platform assembly from its raised position for servicing, the coaxial cables 75 are disconnected from the coaxial cables 76 at connectors 76*a*. The power cable 80 is disconnected from power cable 81 at connector 80*a*. The power cable 80 is then connected to the connector located at the free end of power cable 78. The chains 302 are disconnected from the ball bearing swivel 148 of transition assembly 40. Next, power is provided to the motor 52, from the power supply 20. The motor 52 is switched to run in the reverse direction, whereupon the winch assembly unspools the winch cable 44 from the winch drum 176, thus lowering platform assembly 32 to its lowered position. At this time the motor shuts off. As platform assembly 32 is lowered, telecommunications cables are retained in the respective openings of transition assembly 40 as transition assembly 40 travels upwardly within the mast pole shaft 24. Additionally, the openings in the manifold portion of base plate 100 provide guidance for said telecommunications cables as they travel therethrough. Once servicing has been completed, the motor 52 is switched to the forward direction, which acts to spool the winch cable 44 onto winch drum 176, thus raising the platform assembly 32 to its elevated position. Once the platform assembly reaches the operational position, the frequency inverter stops sending current to the motor 52 and the motor stops operating. Thereafter, the cables are reattached to the transition assembly 40, i.e., coaxial cables 75 extending from radio frequency equipment 16 are reattached to the connectors 76*a* and the power cable 80 is disconnected from power cable 78 and reattached to the connector 80*a* extending from transition assembly 40. The chains are reconnected to the ball bearing swivel 148 of transition assembly 40.

Figure 12:
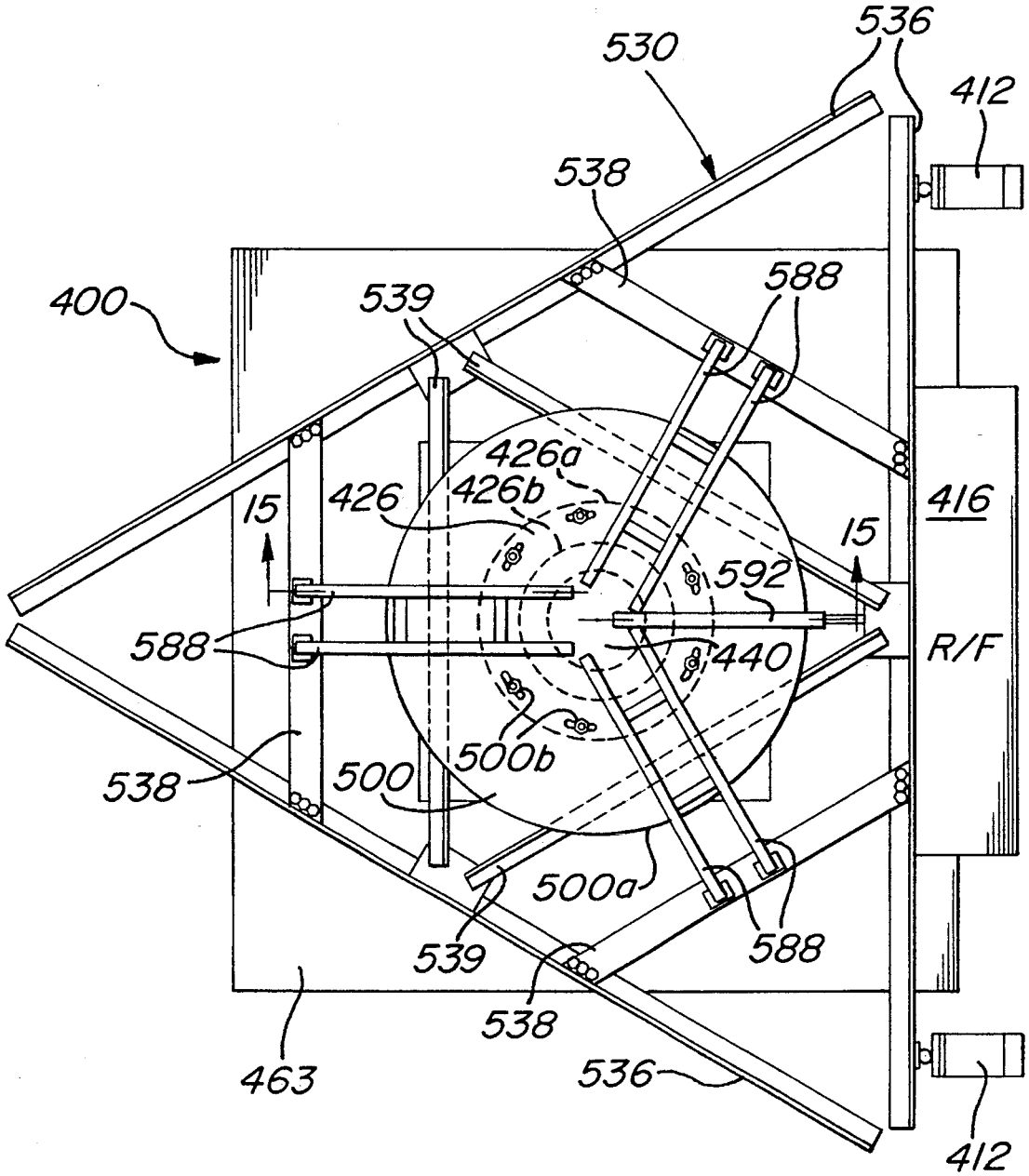
FIG. 12 is a top view of an alternative embodiment of the present invention.
Figure 13:
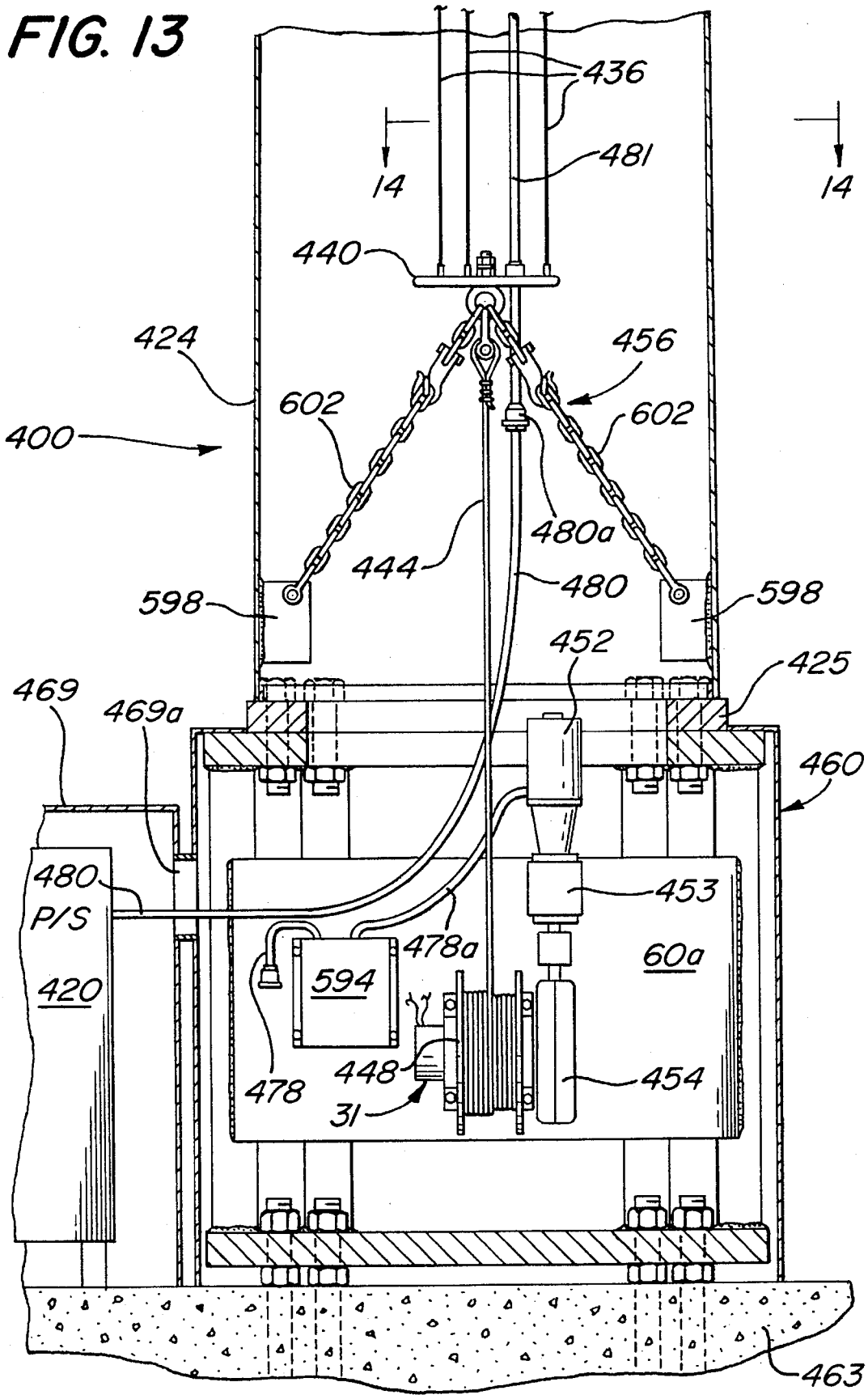
FIG. 13 is an elevational view partially in section of the lower portion of an alternative embodiment of the present invention.
Figure 14:
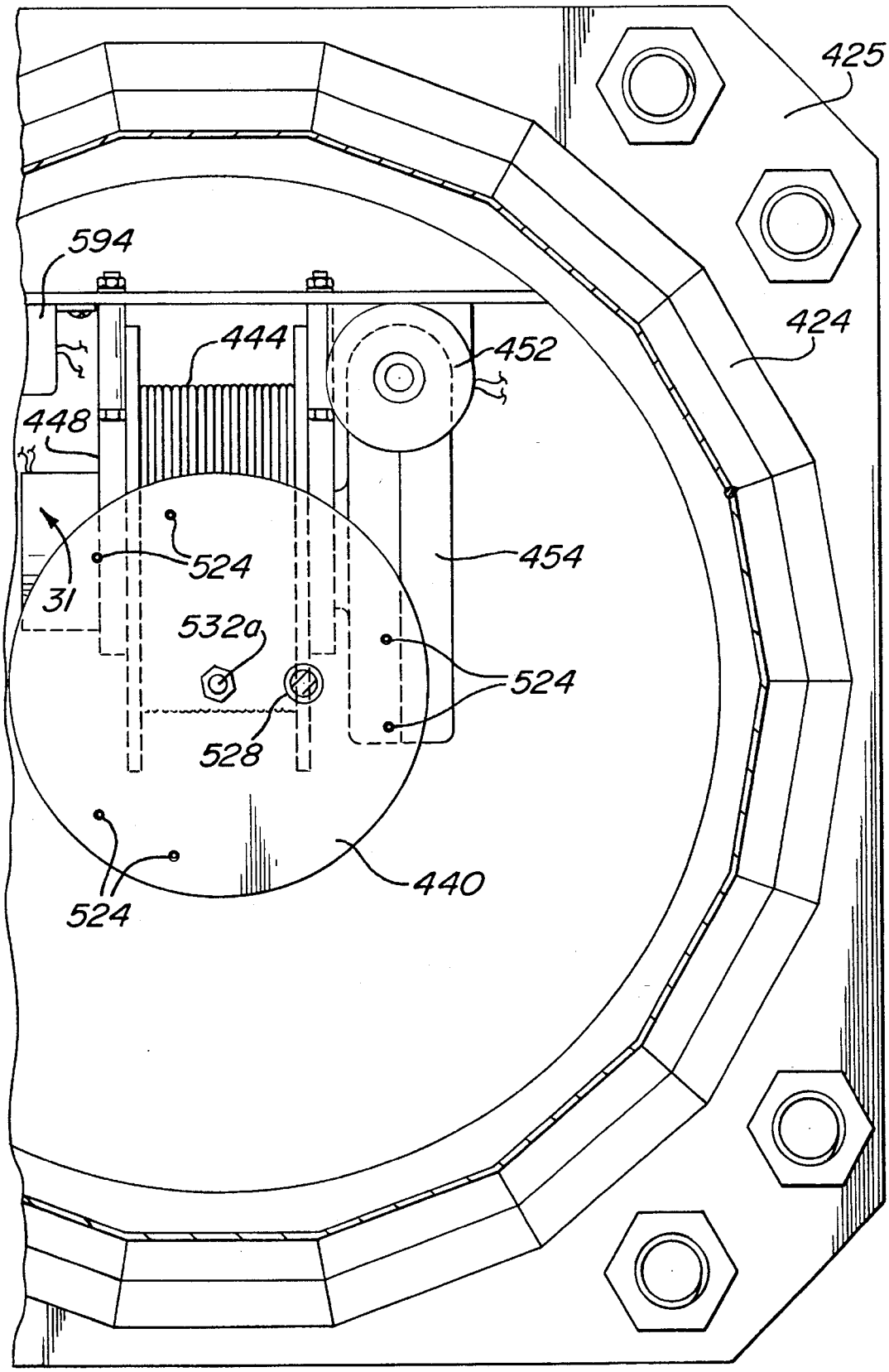
FIG. 14 is an enlarged sectional view taken along line 14—14 of FIG. 13.
Figure 15:
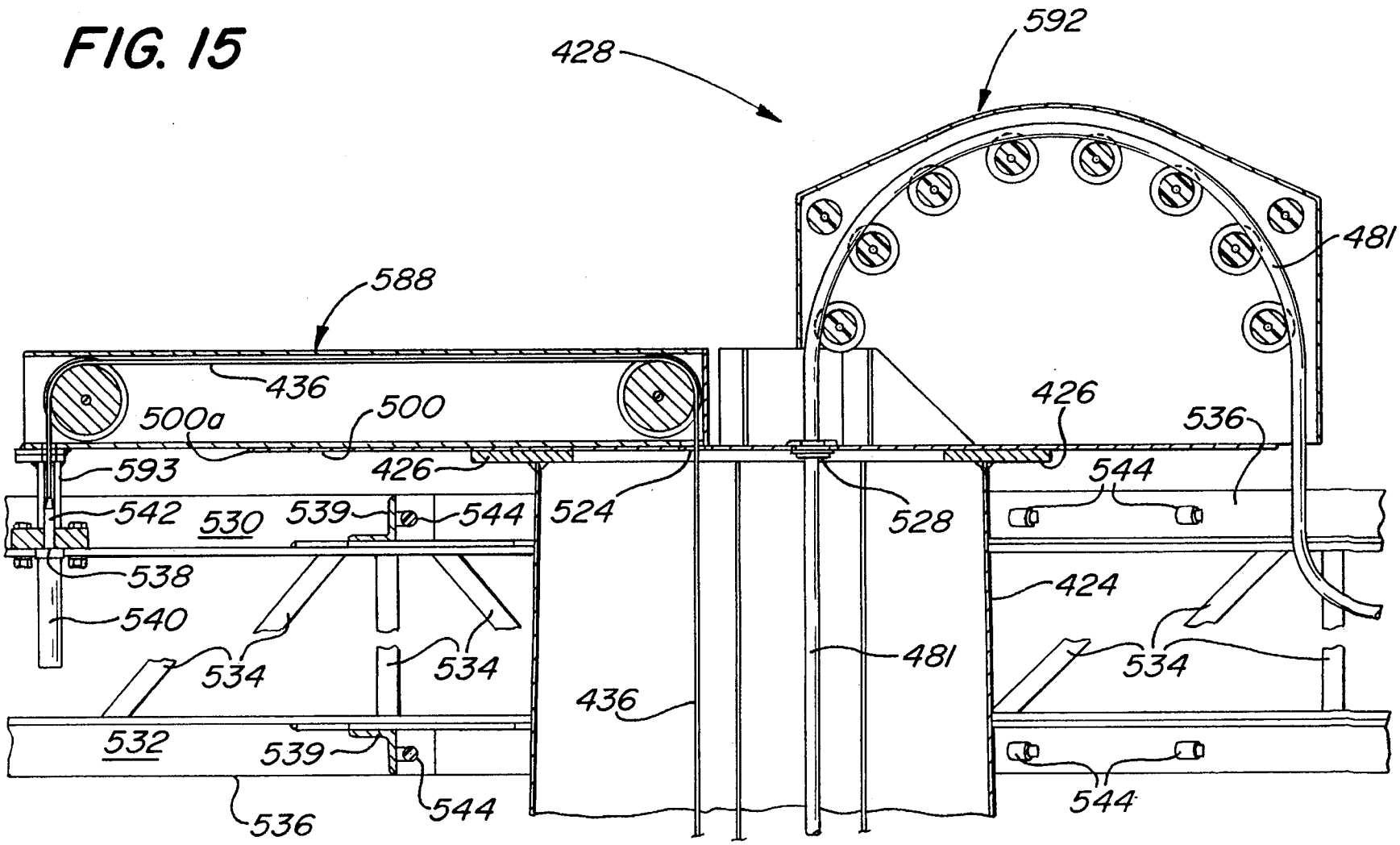
FIG. 15 is a elevational view in section of the top portion of the alternative embodiment of the present invention.

The various major components of the alternative embodiment 400 are shown in FIGS. 12 through 15. The alternative embodiment 400 basically comprises a mast pole shaft 424 having a base flange 425 (FIGS. 13 and 14) and a circular top flange 426 welded to the shaft 424 (FIG. 12). The top flange has an outer edge 426*a* and an inner edge 426*b*. As shown in FIGS. 12 and 15, the alternative embodiment 400 also comprises a headframe assembly 428 having various roller compartments, 588 and 592, mounted on a base plate 500 (FIG. 12). Further, the alternative embodiment includes a platform assembly 432 that could be formed in any number of shapes and sizes, e.g., triangular (FIGS. 12 and 15), a plurality of lift cables 436 (FIG. 13), a transition assembly 440 (FIGS. 13 and 14), a winch assembly 448 (FIG. 13), a winch cable 444 (FIG. 13), an internal motor 452 (FIG. 13), an in-line reducer 453 (FIG. 13), a right-angle reducer 454 (FIG. 13), a frequency inverter 594 (FIG. 13), a bottom latching assembly 456 including safety tie down plates 598, chains 602 (FIG. 13), a base assembly 460 (FIG. 13), and a cabinet 469 adjacent the base assembly 460 (FIG. 13) for housing power supplies 420.

Referring now to FIG. 13, the mast pole shaft 424 of the alternative embodiment attaches to base assembly 460 and base assembly attaches to concrete pad 463 in the same manner as described in the preferred embodiment 10. The base assembly 460 of the alternative embodiment 400 is configured in the same manner as in the preferred embodiment 10 and houses similar components, i.e., internal motor 452, winch assembly 448, gear reducers 453 and 454 and frequency inverter 594 which are mounted to a base mounting plate 460*a*.

In accordance with the alternative embodiment 400, it is a design choice to mount radio frequency equipment 416 on triangular platform assembly 432 rather than positioning that equipment at ground level. As shown in FIG. 13, a conduit 469*a* provides access between the cabinet 469 and the base assembly 460 to enable the routing of the power cable 480 from the power supply 420 into the base assembly 460. Current is delivered from the power supply 420 to the radio frequency equipment 416 mounted on the triangular platform assembly 432 by means of the power cable 480. This cable extends through the conduit 469*a* and upwardly through the mast pole shaft 424. The power cable 480 is detachably connected to the power cable 481 by means of the connector 480*a*. The power cable 481 extends through the transition assembly 440 and upwardly through the mast pole shaft 424 for connection to equipment, e.g., radio frequency equipment 416, mounted on the platform 432. As in the preferred embodiment, when it is desired to lower platform assembly 32 to a position for servicing, power cable 480 is detached from connector 480*a* and is connected to the connector located at the free end of power cable 478.

The transition assembly 440 of the alternative embodiment, shown in FIGS. 13 and 14, is generally circular in shape and may be fabricated from any suitable material, e.g., galvanized sheet steel. As shown in FIG. 14, the transition assembly 440 is provided with a plurality, e.g., six, lift cable openings 524, a threaded power cable opening 528 and a centrally located winch cable opening 532*a*. FIG. 13 shows the lift cables 436 attached to the transition assembly 440 by any conventional means, such as that described in connection with the preferred embodiment and extending upwardly through the interior of the mast pole shaft 424 toward the headframe assembly 428. The power cable 481 passes through the transition assembly 440 and extends upwardly through the interior of the mast pole shaft 424 toward headframe assembly 428. The power cable 481 is gripped within the opening 528 by any suitable means, e.g., strain relief cable grips as previously described in this specification. The winch cable 444 attaches to the transition assembly 440 at the winch cable opening 532 by the means previously described in the preferred embodiment.

The headframe assembly 428 of the alternative embodiment is shown in FIG. 12 and comprises a plurality of lift cable roller compartments 588, and power cable roller compartments 592 mounted by conventional means, e.g., bolting, to the base plate 500. The base plate 500 is provided with slotted holes 500*b* to enable attachment of the base plate 500 to the top flange 426 by conventional means, e.g., bolting. The base plate 500 of the alternative embodiment 400 is provided with a centrally located manifold portion (not shown) similar in arrangement to the manifold portion described in the preferred embodiment (and shown in FIG. 3), except for the provision of the openings for coaxial signal cables. The manifold portion of base plate 500 is provided with a plurality of lift cable openings 502 and a power cable opening 504. Since in this embodiment, the radio frequency equipment 416 is mounted on the triangular platform assembly 432, rather than at ground level, there is no need to provide openings for the coaxial cables in the manifold portion of base plate 500 or in transition assembly 440 since no coaxial signal cables run along the outside of the mast pole shaft 424. Instead, the coaxial signal cables (not shown) run a short distance from the radio frequency equipment 416 mounted on platform assembly 432 to platform mounted antennae 412, thus improving radio performance.

Each of the lift cable openings and the power cable opening in the manifold portion of base plate 500 is located to correspond to the lift cable openings 524 and power cable opening 528 located on transition assembly 440 mentioned previously. Each of the openings in the manifold portion of the base plate 500 is fitted with a cylindrical bushing similar to that described in the preferred embodiment and shown in FIG. 11 in order to minimize friction and drag during raising and lowering of the triangular platform assembly 432.

The orientation of the lift cable roller compartments 588 and power cable roller compartment 592 is shown in FIGS. 12 and 15. As shown in FIG. 15, each lift cable roller compartment 588 is positioned with one end situated over a lift cable opening 524 at the manifold portion of the base plate 500 and the other end extending beyond the outer periphery 500*a* of base plate 500. Similarly, the power cable roller compartment 592 is positioned with one end situated over a power cable opening 528 of the base plate 500 and the other end extending beyond the outer periphery 500*a* of base plate 500.

As shown in FIGS. 13 and 15, the lift cables 436 and the power cable 481 extend upwardly from transition assembly 440 and through the openings in the manifold portion of base plate 500. The openings in the manifold assembly provide a means for guiding the lift cables 436 and the power cable 481 in a manner similar to that described in the preferred embodiment. As shown in FIG. 15, the internal construction of the lift cable roller compartments 588 and the power cable roller compartment 592 of this embodiment is basically the same as that described in the preferred embodiment. As in the preferred embodiment, each lift cable roller compartment 588 is provided with a downwardly facing guide pin receptacles 593 to ensure repeatability as previously discussed in connection with the preferred embodiment 10. The lift cables 436 and the power cable 481 exit the roller compartments 588 and 592, respectively, and extend downwardly through the guide pin receptacles 593 and along the outside of the mast pole shaft 424 toward the triangular platform assembly 432.

The details of triangular platform assembly 432 are shown in FIGS. 12 and 15 and basically comprises an upper tier 530 and a lower tier 532 that are connected by joining sections 534. However, it should be understood that in accordance with this invention, any number of tiers could be joined together as necessary to form a platform for mounting telecommunications equipment, e.g., rectifiers, radio frequency equipment, power supplies, etc. Additionally, the platform assembly does not necessarily have to be triangular in shape. As shown in FIG. 12, the upper tier 530 of platform assembly 432 comprises a plurality of angle-iron pieces 536 that are oriented end-to-end to form a triangular outer shape. The angle-iron pieces 536 are held in position by connection to cross-members 538 and support members 539 by any suitable means, e.g., welding or bolting. The lower tier 532 is similar in construction and configuration to the upper tier 530. The antennae 412 and the radio frequency equipment 416 are mounted to the outside surface of angle-iron members 536 between the upper 530 and lower 532 tiers.

As previously stated, the coaxial signal cables (not shown) run a short distance from the radio frequency equipment 416 mounted on platform assembly 432 to the platform mounted antennae 412, thus improving radio performance. In this embodiment, since the distance between the antennae 412 and radio frequency equipment 416 has been considerably shortened (as compared to prior art antenna systems), radio performance is significantly enhanced. Additionally, since the expensive radio frequency equipment is mounted on the platform assembly 432, rather than at ground level, the threat of vandalism is reduced. Additionally, since equipment is platform mounted, this alternative embodiment may be implemented on a smaller tract of land than prior art systems.

Referring now to FIG. 15, as in the preferred embodiment, the upper tier 530 of the triangular platform assembly 432 of the system 400 is provided with a plurality of spring housings 540 and guide pins 542. The spring housings 540 are attached to the lower surface of a cross-member 538 and extend downwardly. Each of the spring housings contains a compression spring (not shown). Guide pins 542 are provided on the upper surface of the cross-member 538 and extend upwardly. The triangular frame assembly 432 is suspended around the mast pole shaft 424 by means of the lift cables 436, which extend downwardly from the headframe assembly 428 and pass through the upwardly facing guide pins 542 and spring housings 540. The lift cables 436 are held within spring housings 540 by the means described in connection with the preferred system 10. The triangular platform assembly may be lowered from its elevated position for servicing of antennae 412 and other platform mounted equipment, e.g., radio frequency equipment.

Referring now to FIG. 15, the upper and lower tiers are also provided with a plurality of rollers 544 to protect the platform assembly 432 and mast pole shaft 424 during raising and lowering of platform assembly 432.

The operation of the alternative embodiment of system 400 is similar to the operation of the preferred embodiment of system 10.

At this point it bears repeating that the shapes and sizes of the various components described herein are shown for the purpose of example only and other shapes and/or sizes could be utilized without departing from the spirit of this invention. Further, the number of components shown and the number of openings shown passing through those components are exemplary as well and a greater or fewer number of components and openings therethrough could be employed without departing from the spirit of this invention.

What is claimed is:

1. A system for lowering and raising first telecommunications equipment along a mast pole, the first telecommunications equipment being connected with second telecommunications equipment positioned at ground level by means of at least one telecommunications cable, the telecommunications cable having a first end connected to the first telecommunications equipment and a second end connected to the second telecommunications equipment, the second end of the telecommunications cable being detachable from the second telecommunications equipment to enable the lowering and raising of the first telecommunications equipment, said system comprising:

a. an elongated mast pole having an open upper end, a lower end, an external surface and a passageway extending between said open upper end and said lower end;

b. platform means surrounding the external surface of said mast pole and moveable along a length thereof, said platform means being arranged for mounting of the first telecommunications equipment thereon;

c. frame means attached to said mast pole adjacent said open upper end, said frame means comprising pulley means, means for guiding at least one lift cable and means for guiding at least one telecommunications cable;

d. at least one lift cable having a first end and a second end, said first end being connected to said platform means, said lift cable extending over said pulley means, through said guiding means and through the passageway of said mast pole;

e. hoisting means coupled to the lower end of said mast pole, said hoisting means including a winch cable having a free end, said hoisting means being provided for selectively raising said platform means to an elevated position adjacent the upper end of said mast pole and lowering said platform means to a lowered position adjacent the lower end of said mast pole; and f. transition means located within the passageway of said mast pole, said transition means coupling the second end of said at least one lift cable to the free end of said winch cable, said transition means further comprising means for retaining at least one telecommunications cable.

2. The system of claim 1 wherein said hoisting means comprises a winch drum on which said winch cable is wound, said winch drum being located at the lower end of said mast pole.

3. The system of claim 2 wherein said hoisting means further comprises a motor coupled to said winch drum.

4. The system of claim 3 wherein said hoisting means further comprises a first gearing means, said first gearing means being interposed between said motor and said winch drum and having a first end coupled to said motor and a second end coupled to said winch drum.

5. The system of claim 4 wherein said hoisting means further comprises a second gearing means, said second gearing means being interposed between said first gearing means and said winch drum and having a first end coupled to said first gearing means and a second end coupled to said winch drum.

6. The system of claim 5 wherein said first gearing means comprises an in-line reducer and said second gearing means comprises a right-angle reducer.

7. The system of claim 6 wherein said hoisting means further comprises a frequency inverter coupled to said motor.

8. The system of claim 1 wherein said mast pole tapers uniformly over its entire length from its lower end toward its upper end.

9. The system of claim 1 wherein said transition means comprises at least one lift cable opening extending therethrough for coupling the second end of said at least one lift cable to said transition means.

10. The system of claim 9 wherein said transition means further comprises a winch cable opening extending therethrough for coupling the free end of said winch cable to said transition means.

11. The system of claim 10 further comprising a winch cable connection means positioned within said winch cable opening of said transition means for coupling the free end of said winch cable to said transition means.

12. The system of claim 11 wherein said winch cable connection means comprises a ball bearing swivel.

13. The system of claim 10 wherein said transition means comprises a central portion and wherein said winch cable opening is located in the central portion of said transition means.

14. The system of claim 1 wherein said means for retaining at least one telecommunications cable of said transition means comprises means for retaining at least one signal cable.

15. The system of claim 14 wherein said means for retaining at least one signal cable comprises at least one signal cable opening extending through said transition means and a cable grip attached thereto.

16. The system of claim 15 wherein said at least one signal cable opening is threaded.

17. The system of claim 1 wherein said means for retaining at least one telecommunications cable of said transition means comprises means for retaining at least one power cable.

18. The system of claim 17 wherein said means for retaining at least one power cable comprises at least one power cable opening extending through said transition means and a cable grip attached thereto.

19. The system of claim 18 wherein said at least one power cable opening is threaded.

20. The system of claim 15 wherein said transition means further comprises means for retaining at least one power cable.

21. The system of claim 20 wherein said means for retaining at least one power cable comprises at least one power cable opening extending through said transition means and a cable grip attached thereto.

22. The system of claim 21 wherein said at least one power cable opening is threaded.

23. The system of claim 22 wherein said transition means is generally triangular in shape.

24. The system of claim 18 wherein said transition means is generally circular in shape.

25. The system of claim 1 wherein said platform means comprises a generally circular center ring having an inner surface, an outer surface and a bottom surface.

26. The system of claim 25 wherein said platform means additionally comprises at least one antenna mounting arm, said antenna mounting arm having a first end connected to the outer surface of said center ring and a second end extending outwardly from said center ring, the second end being arranged for mounting of at least one antenna thereon.

27. The system of claim 25 wherein said platform means additionally comprises at least one luminaire mounting arm, said luminaire mounting arm having a first end connected to the outer surface of said center ring and a second end extending outwardly from said center ring, the second end being arranged for mounting of at least one luminaire thereon.

28. The system of claim 25 wherein said platform means further comprises at least one roller attached to the inner surface of said circular ring.

29. The system of claim 1 wherein the platform means is adapted for supporting telecommunications means comprising at least one antenna and at least one unit of telecommunications equipment connected thereto and wherein said platform means is arranged to support the at least one antenna and the at least one unit of telecommunications equipment thereon.

30. The system of claim 29 wherein said platform means comprises at least two tiers connected by joining means.

31. The system of claim 30 wherein each said tier is generally triangular in shape.

32. The system of claim 1 wherein said frame means additionally comprises a base plate having a center portion and a top surface, said pulley means being mounted to the top surface of said base plate.

33. The system of claim 32 wherein said base plate comprises said means for guiding at least one telecommunications cable and said means for guiding at least one lift cable.

34. The system of claim 33 wherein said means for guiding at least one lift cable comprises at least one lift cable opening extending through said base plate.

35. The system of claim 34 wherein said means for guiding at least one telecommunications cable comprises at least one signal cable opening extending through said base plate.

36. The system of claim 35 wherein said at least one signal cable opening is located in the center portion of said base plate.

37. The system of claim 34 wherein said at least one lift cable opening is located in the center portion of said base plate.

38. The system of claim 36 further comprising a bushing located within said at least one signal cable opening.

39. The system of claim 33 wherein said means for guiding at least one telecommunications cable comprises at least one power cable opening extending through said base plate.

40. The system of claim 39 wherein said at least one power cable opening is located in the center portion of said base plate.

41. The system of claim 40 further comprising a bushing located within said at least one power cable opening.

42. The system of claim 35 further comprising at least one power cable opening extending through said base plate.

43. The system of claim 42 wherein said at least one power cable opening is located in the center portion of said base plate.

44. The system of claim 43 further comprising a bushing located within said at least one power cable opening.

45. The system of claim 42 wherein said base plate is generally circular.

46. The system of claim 1 wherein said pulley means comprises at least one telecommunications cable roller means and at least one lift cable roller compartment.

47. The system of claim 46 wherein said telecommunications cable roller means comprises at least one signal cable roller compartment.

48. The system of claim 46 wherein said telecommunications cable roller means comprises at least one power cable roller compartment.

49. The system of claim 47 wherein said telecommunications cable roller further comprises at least one power cable roller compartment.

50. The system of claim 36 wherein said at least one lift cable opening is arranged to allow passage therethrough of a lift cable having a thickness, said at least one lift cable opening being sized substantially the same as the thickness of said lift cable, and wherein said at least one signal cable opening is arranged to allow passage therethrough of a signal cable having a thickness, said at least one signal cable opening being sized substantially the same as the thickness of the signal cable, said base plate being closed except for said at least one lift cable opening and said at least one signal cable opening to prevent ingress of unwanted materials therethrough.

51. The system of claim 50 further comprising at least one power cable opening extending through said base plate, said at least one power cable opening being arranged to allow passage therethrough of a power cable having a thickness, said at least one power cable opening being sized substantially the same as the thickness of said power cable.

52. The system of claim 1 wherein said platform means is provided with a top surface and said frame means is provided with a bottom surface, said system additionally comprising a plurality of docking pins connected to the top surface of said platform means and extending upwardly, said system additionally comprising a plurality of docking pin receptacles connected to the bottom surface of said frame means, said docking pins being opposed to said receptacles and arranged to fit within said receptacles when said platform means is raised to said elevated position to assure precise repeatability of said first telecommunications equipment.

* * * * *